US010171928B2

(12) United States Patent
Nair

(10) Patent No.: US 10,171,928 B2
(45) Date of Patent: Jan. 1, 2019

(54) BINAURAL SYNTHESIS

(71) Applicant: Facebook, Inc., Menlo Park, CA (US)

(72) Inventor: Varun Nair, Edinburgh (GB)

(73) Assignee: Facebook, Inc., Menlo Park, CA (US)

( * ) Notice: Subject to any disclaimer, the term of this patent is extended or adjusted under 35 U.S.C. 154(b) by 0 days.

(21) Appl. No.: 15/232,327

(22) Filed: Aug. 9, 2016

(65) Prior Publication Data

US 2017/0105083 A1 Apr. 13, 2017

(30) Foreign Application Priority Data

Oct. 8, 2015 (GB) ..... 1517844.5

(51) Int. Cl.

| | |
|---|---|
| ***H04S 7/00*** | (2006.01) |
| ***H04R 5/00*** | (2006.01) |
| ***H04R 3/00*** | (2006.01) |
| *H04R 5/033* | (2006.01) |

(52) U.S. Cl.

CPC ..... *H04S 7/30* (2013.01); *H04R 5/033* (2013.01); *H04S 7/307* (2013.01); *H04S 2400/01* (2013.01); *H04S 2420/01* (2013.01)

(58) Field of Classification Search

CPC ... H04S 7/00; H04S 7/30; H04S 7/302; H04S 7/306; H04S 7/307; H04S 2420/01; H04S 2400/01; H04R 3/00; H04R 3/04; H04R 3/005; H04R 3/12; H04R 5/00; H04R 5/033

See application file for complete search history.

(56) References Cited

U.S. PATENT DOCUMENTS

| | | | | |
|---|---|---|---|---|
| 6,553,121 | B1 * | 4/2003 | Matsuo | H04S 1/002 381/17 |
| 8,265,284 | B2 * | 9/2012 | Villemoes | G10L 19/008 381/22 |
| 2005/0271214 | A1 * | 12/2005 | Kim | H04S 1/002 381/17 |
| 2007/0223751 | A1 * | 9/2007 | Dickins | H04S 3/004 381/310 |
| 2011/0091046 | A1 | 4/2011 | Villemoes | |

(Continued)

FOREIGN PATENT DOCUMENTS

| | | |
|---|---|---|
| WO | WO 2009/111798 A2 | 9/2009 |
| WO | WO 2014/035728 A2 | 3/2014 |

OTHER PUBLICATIONS

United Kingdom Intellectual Property Office, Combined Search and Examination Report under Sections 17 and 18(3), UK Patent Application No. GB 1517844.4, dated Mar. 13, 2017, seven pages.

(Continued)

*Primary Examiner* — Thang V Tran
(74) *Attorney, Agent, or Firm* — Fenwick & West LLP

(57) ABSTRACT

Embodiments relate to obtaining filter coefficients for a binaural synthesis filter; and applying a compensation filter to reduce artifacts resulting from the binaural synthesis filter; wherein the filter coefficients and compensation filter are configured to be used to obtain binaural audio output from a monaural audio input. The filter coefficients and compensation filter may be applied to the monaural audio input to obtain the binaural audio output. The compensation filter may comprise a timbre compensation filter.

25 Claims, 6 Drawing Sheets

(56) References Cited

U.S. PATENT DOCUMENTS

2015/0312695 A1* 10/2015 Enamito ..... H04S 1/002
381/303
2017/0094440 A1* 3/2017 Brown ..... H04S 7/304

OTHER PUBLICATIONS

Brown, C. et al., "A Structural Model for Binaural Sound Synthesis," IEEE Transaction on Speech and Audio Processing, vol. 6, No. 5, Sep. 1998, pp. 476-488.
Chan, C. etr al., "A Minimum Bounding Box Algorithm and its Application to Rapid Prototyping," The University of Texas in Austin SFF Symposium Proceeding, Aug. 1999, pp. 163-170.
Collins, A. "FIR Filter Design," Date Unknown, three pages. [Online] [Retrieved Nov. 17, 2016] Retrieved from the Internet <http://www.arc.id.au/FilterDesign.html>.
Mamou, K. et al., "A Simple and Efficient Approach for 3D Mesh Approximate Convex Decomposition," International Conference on Image Processing, Nov. 2009, pp. 3501-3504.
Mamou, K., "HACD: Hierarchical Approximate Convex Decomposition," Oct. 2, 2011, seven pages. [Online] [Retrieved Sep. 16, 2015] Retrieved from the internet <http://kmamou.blogspot.co.uk/2011/10/hacd-hierarchical-approximate-convex.html>.
Savioja, L. et al., "Creating Interactive Virtual Acoustic Environments," J. Audio Eng. Soc., vol. 47, No. 9, Sep. 1999, pp. 675-705.
Schissler, C. et al., "GSound: Interactive Sound Propagation for Games," Proc. of AES 41st Conference: Audio for Games, 2011, six pages.

* cited by examiner

BINAURAL SYNTHESIS

CROSS-REFERENCE TO RELATED APPLICATION

This application claims priority under 35 U.S.C. § 119(a) to United Kingdom Patent Application No. 1517844.5 filed on Oct. 8, 2015, which are incorporated by reference herein in their entirety.

BACKGROUND

The present invention relates to binaural audio synthesis.

3D audio or binaural synthesis may refer to a technique used to process audio in such a way that a sound may be positioned anywhere in 3D space. The positioning of sounds in 3D space may give a user the effect of being able to hear a sound over a pair of headphones, or from another source, as if it came from any direction (for example, above, below or behind). 3D audio or binaural synthesis may be used in applications such as games, virtual reality or augmented reality to enhance the realism of computer-generated sound effects supplied to the user.

When a sound comes from a source far away from a listener, the sound received by each of the listener's ears may, for example, be affected by the listener's head, outer ears (pinnae), shoulders and/or torso before entering the listener's ear canals. For example, the sound may experience diffraction around the head and/or reflection from the shoulders.

If the source is to one side of the listener, the sound received from the source may be received at different times by the left and right ears. The time difference between the sound received at the left and right ears may be referred to as an Interaural Time Delay (ITD). The amplitude of the sound received by the left and right ears may also differ. The difference in amplitude may be referred to as an Interaural Level Difference (ILD).

Binaural synthesis may aim to process monaural sound (a single channel of sound) into binaural sound (a channel for each ear, for example a channel for each headphone of a set of headphones) such that it appears to a listener that sounds originate from sources at different positions relative to the listener, including sounds above, below and behind the listener.

A head-related transfer function (HRTF) is a transfer function that may capture the effect of the human head (and optionally other anatomical features) on sound received at each ear. The information of the HRTF may be expressed in the time domain through the head-related impulse response (HRIR). Binaural sound may be obtained by applying an HRIR to a monaural sound input.

It is known to obtain an HRTF (and/or an HRIR) by measuring sound using two microphones placed at ear positions of an acoustic manikin. The acoustic manikin may provide a representative head shape and ear spacing and, optionally, the shape of representative pinnae, shoulders and/or torso.

Methods are known in which finite impulse response (FIR) filter coefficients are generated from HRIR measurements. The HRIR-generated FIR coefficients are convolved with an input audio signal to synthesise binaural sound. A FIR filter generated from HRIR measurements may be a high-order filter, for example a filter of between 128 and 512 taps. An operation of convolving the FIR filter with an input audio signal may be computationally intensive, particularly when the relative positions of the source and the listener change over time.

It has been suggested to approximate an HRIR using a computational model, for example a structural model. A structural model may simulate the effect of a listener's body on sound received by the listener's ears. In one such structural model, effects of the head, pinnae and shoulders are modeled. The structural model combines an infinite impulse response (IIR) head-shadow model with an FIR pinna-echo model and an FIR shoulder-echo model.

SUMMARY

In a first aspect of the invention, there is provided a method comprising obtaining filter coefficients for a binaural synthesis filter; and applying a compensation filter to reduce artefacts resulting from the binaural synthesis filter; wherein the filter coefficients and compensation filter are configured to be used to obtain binaural audio output from a monaural audio input. The filter coefficients and compensation filter may be applied to the monaural audio input to obtain the binaural audio output. The compensation filter may comprise a timbre compensation filter.

The artefacts may be artefacts that are introduced by the binaural synthesis filter itself. By reducing artefacts resulting from the binaural synthesis filter, binaural processing may result in a better quality output that may be the case if the artefacts were not reduced. By reducing artefacts resulting from the binaural synthesis filter, the binaural audio output may be more similar to the monaural audio input and/or more similar to that of an original audio source than would otherwise be the case. A user's perception of the binaural audio output may be more similar to the user's perception of the monaural audio input than would otherwise be the case.

The artefacts may comprise a reduction in quality of a binaural audio output. The reduction in quality of the binaural audio output may comprise the quality of the binaural audio output being lower than the quality of the monaural audio input. The artefacts may comprise at least one of a change in amplitude of a binaural audio output, a change in delay of a binaural audio output, a change in frequency of a binaural audio output. The artefacts may comprise at least one of a change in amplitude of a binaural audio output with respect to an amplitude of the monaural audio input, a change in delay of a binaural audio output with respect to a delay of the monaural audio input, a change in frequency of a binaural audio output with respect to a frequency of the monaural audio input.

The timbre of a sound may comprise a property or properties of the sound that is experienced by the user as imparting a particular tone or colour to the sound. Thus for example, two sounds may have the same pitch and loudness but may have different timbres and thus may sound different, for example to a human listener. Timbre for example may comprise one or more of at least one spectral envelope property, at least one time envelope property, at least one modulation or shift in time envelope, fundamental frequency or time envelope, at least one variation of amplitude with time and/or frequency. By reducing artefacts resulting from the binaural synthesis filter, a timbre of the binaural audio output may be more similar to a timbre of the monaural audio input than would otherwise be the case. A user may experience the timbre of the binaural audio output to be similar to a timbre of the monaural audio output.

In some audio systems, timbre may be particularly relevant. For example, in high quality audio systems, it may be preferable that binaural processing does not make any discernible change in the timbre of the sound that is experienced by a user. A change in timbre may be experienced by the user as distortion and/or poor quality audio reproduction.

In some systems, it may be preferable for a user to experience accurate timbre reproduction even at the expense of decreased accuracy of binaural effects, for example decreased localisation.

The timbre compensation filter may be determined independently of physical properties of at least part of the audio system. The timbre compensation filter may be determined independently of physical properties of headphones. The timbre compensation filter may be determined independently of physical characteristics of a user. Thus, for example, physical properties of at least part of the audio system and/or physical characteristics of a user may be not used as inputs in determining the timbre compensation filter.

The binaural audio output may occupy a frequency range. The artefacts may be present in a sub-region of the frequency range. The sub-region may comprise audible frequencies of the human voice. The sub-region may comprise frequencies that are relevant to the perceived timbre of the human voice.

The sub-region of the frequency may be a portion of the frequency range that is above a lower portion of the frequency range. The artefacts may be not present in the lower portion of the frequency range. The artefacts may be more severe in the sub-region than in a portion of the frequency range that is lower in frequency than the sub-region. The artefacts may be more severe in the sub-region than in a further portion of the frequency range that is higher in frequency than the sub-region. The sub-region may comprise a range of frequencies in which the artefacts are greater than are the artefacts in other parts of the frequency range.

The artefacts may comprise an increase in gain in the sub-region. Reducing the artefacts may comprise reducing the gain in the sub-region, such as to at least partially compensate for the artefacts. The gain may be substantially unchanged by the timbre compensation in at least one region of the frequency range that is outside the sub-region.

The sub-region may comprise a range of frequencies from 500 Hz to 10 kHz, optionally from 1 kHz to 6 kHz, further optionally from 1 kHz to 3 kHz. The sub-region may comprise frequencies above 500 Hz, optionally frequencies above 1 kHz, further optionally frequencies above 2 kHz, further optionally frequencies above 3 kHz. Frequencies between 1 kHz and 6 kHz may be important for speech intelligibility.

The sub-region may comprise a range of frequencies from 80 Hz to 400 Hz. A range from 80 Hz to 400 Hz may be important for good low frequency reproduction which may be useful for music.

In professional audio, a range of frequencies between 20 Hz to 20 kHz may be of importance. The timbre compensation filter may be such that the binaural system may change the frequency spectrum between 20 Hz and 20 kHz as little as possible.

Applying the compensation filter to reduce artefacts may comprise a greater reduction in artefacts in the sub-region than in other parts of the frequency range.

Applying the compensation filter may comprise applying the compensation filter to the filter coefficients to obtain adjusted coefficients for the binaural synthesis filter.

Applying the compensation filter to the filter coefficients may provide a computationally efficient method of reducing artefacts. Applying the compensation filter to the filter coefficients may be faster and/or more computationally efficient than applying a filter to the binaural audio output.

The method may further comprise receiving a monaural audio input corresponding to at least one audio source, each audio source having an associated position. The method may further comprise synthesising binaural audio output from the monaural audio input using the binaural synthesis filter. The synthesising may be in dependence on the position or positions of each audio source. By performing binaural synthesis in dependence on audio source positions, a user may experience sound from each of the audio sources as coming from the position of that audio source.

The synthesising of the binaural audio output may use the adjusted filter coefficients.

The filter coefficients may be adjusted by the timbre compensation filter such that binaural audio output synthesised using the adjusted coefficients has a different timbre from binaural audio output synthesised using the filter coefficients, thereby reducing the effect of the artefacts.

The synthesising may be performed in real time. The position of each audio source may change with time. The synthesising of the binaural audio output may be updated with the changing position of the audio source or sources.

By performing synthesis in real time, the synthesis may respond to changes in the scene. For example, in a computer game, a user may experience an effect of moving through the scene. The binaural audio output may be synthesised in response to changing positions, for example changing positions, optionally relative positions, of the user and/or the audio sources.

The method may further comprise generating the timbre compensation filter from the filter coefficients. Generating the timbre compensation filter from the filter coefficients may comprise applying a filter defined by the filter coefficients to a test audio input to obtain an impulse response; obtaining a transfer function by applying a Fourier transfer to the impulse response; and generating the timbre compensation filter from the transfer function.

Generating the timbre compensation filter may comprise generating coefficients for the timbre compensation filter. The timbre compensation filter may comprise a finite impulse response filter.

Generating the timbre compensation filter from the transfer function may comprise inverting the transfer function to obtain an inverse transfer function. Generating the timbre compensation filter may comprise smoothing at least one of the transfer function, the inverse transfer function, the impulse response. Generating the timbre compensation filter may comprise obtaining a new impulse response from the inverse transfer function.

Generating the timbre compensation filter may further comprise reducing the effect of the timbre compensation filter at low frequencies, optionally wherein the low frequencies comprise frequencies below 400 Hz. The timbre compensation filter may be altered such that the low frequencies remain substantially unchanged by the timbre compensation filter. The low frequencies may comprise frequencies below 1 kHz, optionally frequencies below 500 Hz, further optionally frequencies below 300 Hz. Reducing the effect of the timbre compensation at low frequencies may mean that the original low frequency response of the binaural synthesis filter is retained.

The timbre compensation filter may correct frequencies below 400 Hz. The binaural synthesis filter may result in a boost in low frequencies. Such a boost in low frequencies may be corrected by the timbre compensation filter.

Generating the timbre compensation filter may comprise generating the timbre compensation filter for each of a plurality of sampling rates. By generating the timbre compensation filter for a plurality of sampling rates, the timbre compensation filter may be used in a range of different audio systems, even if the different audio systems have different sampling rates. In some circumstances, having a plurality of sampling rates may make any resampling of coefficients of the timbre compensation filter easier, since it may be more likely that a resampling will comprise resampling to an integer multiple of a sampling rate that has already been calculated.

Generating the timbre compensation filter may comprise truncating the timbre compensation filter. Generating the timbre compensation filter may comprise truncating the timbre compensation filter to an order no higher than an order of the binaural synthesis filter.

The binaural synthesis filter may comprise a first number of taps. The binaural synthesis filter may comprise 32 taps. The binaural synthesis filter may comprise between 20 and 40 taps.

The timbre compensation filter may comprise a second number of taps. The second number of taps may be fewer than or equal to the first number of taps. The second number of taps may be fewer than the first number of taps. The timbre compensation filter for a first sampling rate may have a different number of taps than the timbre compensation filter for a second sampling rate. A timbre compensation filter for a first sampling rate may have 27 taps and a timbre compensation filter for a second sampling rate may have 31 taps.

By providing a timbre compensation filter having fewer taps than the binaural synthesis filter, the application of the timbre compensation filter to the binaural synthesis filter may be performed in a way that is computationally efficient.

Adjusted coefficients obtained by applying the timbre compensation filter to the binaural synthesis filter may have a number of taps that is the same as the number of taps of the binaural synthesis filter. Computations performed using the adjusted coefficients may require no more computational resources than computations performed using the filter coefficients. Computations performed using the adjusted coefficients may be as fast as computations performed using the filter coefficients.

The test audio input may comprise an audio input having a known frequency profile. The generating of the timbre compensation filter may be in dependence on a difference between a frequency profile of the binaural audio output and the known frequency profile of the test audio input.

The test audio input may comprise white noise. The test audio input may have a frequency profile that is flat with frequency for at least a portion of the frequency range. The generating of the timbre compensation may comprise determining a difference between a frequency profile of the binaural output and a flat frequency profile for at least a portion of the frequency range.

The binaural synthesis filter may comprise a pinna model filter. Synthesising the binaural audio output may comprise applying the pinna model filter; applying an interaural time delay; and applying a head shadow filter.

The method may comprise determining values for the interaural time delay using the equation:

$$T(\theta, \phi) = \begin{cases} -\frac{a}{c} * \cos(\theta) * \cos(\phi), & 0 \le |\theta| < \frac{\pi}{2} \\ \frac{a}{c} * \left(|\theta| - \frac{\pi}{2}\right) * \cos(\phi), & \frac{\pi}{2} \le |\theta| \le \pi \end{cases}$$

wherein $T(\theta,\phi)$ is the interaural time delay, a is an average head size, c is the speed of sound, $\theta$ is azimuth angle in radians and $\phi$ is elevation angle in radians.

The method may comprise determining values for the head shadow filter using the equation:

$$H(\omega, \theta) = 1 + \frac{j(\alpha * \omega)}{1 + \left(\frac{j\omega}{2\omega_0}\right)}, \; 0 \le \alpha \le 2$$

wherein $H(\omega,\theta)$ is a head shadow filter value, $\theta$ is azimuth angle in degrees, $\omega$ is radian frequency, a is an average head size, c is the speed of sound, $\omega_0$=c/a, and $$\alpha(\theta) = 1.05 + 0.95 * \cos\left(\theta * \frac{\pi}{180}\right).$$

Obtaining filter coefficients may comprise obtaining filter coefficients for each of a plurality of angular positions. Each angular position may comprise an azimuth angle and an elevation angle. Applying the timbre compensation filter may comprise, for each angular position, applying the timbre compensation filter to the filter coefficients for that angular position to obtain adjusted filter coefficients for that angular position. Filter coefficients for the plurality of angular positions may be stored in a look up table. By storing the filter coefficients in a look up table, the filter coefficients may be quickly accessed in a real time process.

The filter coefficients may be obtained as part of an initialisation process.

In a further aspect of the invention, which may be provided independently, there is provided a method comprising obtaining filter coefficients for a binaural synthesis filter; and generating a compensation filter from the filter coefficients, wherein the compensation filter is configured to reduce artefacts resulting from the binaural synthesis filter. The compensation filter may comprise a timbre compensation filter. The filter coefficients and compensation filter may be configured to be applied to a monaural audio input to obtain binaural audio output.

The compensation filter may be generated from filter coefficients for a single angular position. The generating of the compensation filter may be performed offline.

In a further aspect of the invention, which may be provided independently, there is provided a method comprising receiving a monaural audio signal corresponding to at least one audio source, each audio source having an associated position; and synthesising binaural audio output from the monaural audio signal using a binaural synthesis filter, wherein the synthesising is in dependence on the position or positions of each audio source. The binaural synthesis filter may use filter coefficients that have been adjusted using a compensation filter to reduce artefacts resulting from the binaural synthesis filter. The compensation filter may comprise a timbre compensation filter.

The synthesising of the binaural audio output may be performed in real time.

In a further aspect of the invention, which may be provided independently, there is provided an apparatus comprising: means for obtaining filter coefficients for a binaural synthesis filter; and means for applying a timbre compensation filter to reduce artefacts resulting from the binaural synthesis filter; wherein the filter coefficients and timbre compensation filter are configured to be applied to a monaural audio input to obtain binaural audio output.

In a further aspect of the invention, which may be provided independently, there is provided an apparatus comprising a processor configured to: obtain filter coefficients for a binaural synthesis filter; and apply a timbre compensation filter to reduce artefacts resulting from the binaural synthesis filter; wherein the filter coefficients and timbre compensation filter are configured to be applied to a monaural audio input to obtain binaural audio output.

In another aspect of the invention, which may be provided independently, there is provided a method comprising obtaining a monaural audio input representative of an audio source, selecting at least two binaural synthesis models, obtaining a respective binaural audio output for each of the binaural synthesis models by applying coefficients of each binaural synthesis model to the monaural audio input, and obtaining a combined binaural audio output by combining the respective binaural audio outputs from each of the at least two models.

In a further aspect of the invention, which may be provided independently, there is provided a method comprising: obtaining a monaural audio input representative of audio input from a plurality of audio sources; for each audio source, selecting at least one binaural synthesis model from a plurality of binaural synthesis models and applying the at least one binaural synthesis model to audio input from that audio source to obtain at least one binaural audio output; and obtaining a combined binaural audio output by combining binaural audio outputs from each of the plurality of binaural synthesis models.

The plurality of binaural synthesis models may comprise at least one of an HRIR binaural synthesis model, a structural model, and a virtual speakers model.

A first (for example, higher-quality) binaural synthesis model may be selected for a first (for example, higher-priority) audio source. A second (for example, lower-quality) binaural synthesis model may be selected for a second (for example, lower-priority) audio source. A first more computationally intensive binaural synthesis model may be selected for a first higher-priority audio source. A second (for example, less computationally intensive) binaural synthesis model may be selected for a second (for example, lower-priority) audio source.

By providing different binaural synthesis models, different trade-offs may be made in computation. For example, a high-quality, computationally intensive binaural synthesis method may always be selected for a very important audio source. For some other audio sources, a high-quality, computationally intensive binaural synthesis method may be used only when the audio source is close to the position with respect to which the binaural synthesis is performed. When the audio source is further away, a lower quality and less computationally intensive method of binaural synthesis may be used.

Selecting binaural synthesis methods may result in improved or more efficient use being made of the available resources. Where computational resources are not able to synthesise all audio sources at the highest possible quality, it is possible to select which audio sources use the highest-quality binaural synthesis, while performing a lower-quality binaural synthesis for the other audio sources. The user may not notice that a lower-quality binaural synthesis may be used on, for example, sounds that are fainter, farther away, or less interesting to the user.

The selecting of the binaural synthesis models may be dependent on a distance, or other property, of each audio source from a position, for example with respect to which the binaural synthesis is performed.

For an audio source of the plurality of audio sources, selecting at least one binaural synthesis model for the audio source may comprise selecting a first binaural synthesis model and a second, different binaural synthesis model. The combined audio output may comprise a first proportion of an audio output for the audio source from the first binaural synthesis model and a second proportion of an audio output for the audio source from the second binaural synthesis model.

The position of the audio source may change over time, and the first proportion and second proportion may change with time in accordance with the changing position of the audio source.

In some circumstances, the position of an audio source may change such that it is desirable to change the binaural synthesis model that is used to synthesise that audio source. For example, a source may move from being nearer (in which a case higher-quality synthesis model is selected) to being further away (in which case a lower-quality synthesis method is selected). However, if a change between synthesis methods were performed very quickly (for example, between one frame and the next), the change may be perceptible to the user. By using two synthesis methods at once, the output of one may be faded down and the output of the other faded up, so that the change in synthesis method is not perceptible to the user.

Each of the plurality of binaural synthesis models may comprise a respective timbre compensation filter. The timbre compensation filters may being configured to match timbre between the binaural synthesis models.

The binaural synthesis models are selected in dependence on at least one of: a CPU frequency, a computational resource limit, a computational resource parameter, a quality requirement.

The binaural synthesis models may be selected in dependence on a priority of each audio source, a distance associated with each audio source, a quality requirement of each audio source, an amplitude of each audio source.

In another aspect of the invention, which may be provided independently, there is provided an apparatus comprising a processing resource configured to perform a method as claimed or described herein.

The apparatus may further comprise an input device configured to receive audio input representing sound from at least one audio source, wherein the processing resource is configured to obtain binaural audio output by processing the audio input using the binaural synthesis filter and the timbre compensation filter, and wherein the apparatus may further comprise an output device configured to output the binaural audio output.

In another aspect of the invention, which may be provided independently, there is provided a computer program product comprising computer readable instructions that are executable by a processor to perform a method as claimed or described herein.

There may also be provided an apparatus or method substantially as described herein with reference to the accompanying drawings.

Any feature in one aspect of the invention may be applied to other aspects of the invention, in any appropriate combination. For example, apparatus features may be applied to method features and vice versa.

BRIEF DESCRIPTION OF DRAWINGS

Embodiments of the invention are now described, by way of non-limiting examples, and are illustrated in the following figures, in which:—

DETAILED DESCRIPTION OF EMBODIMENTS

Figure 1:
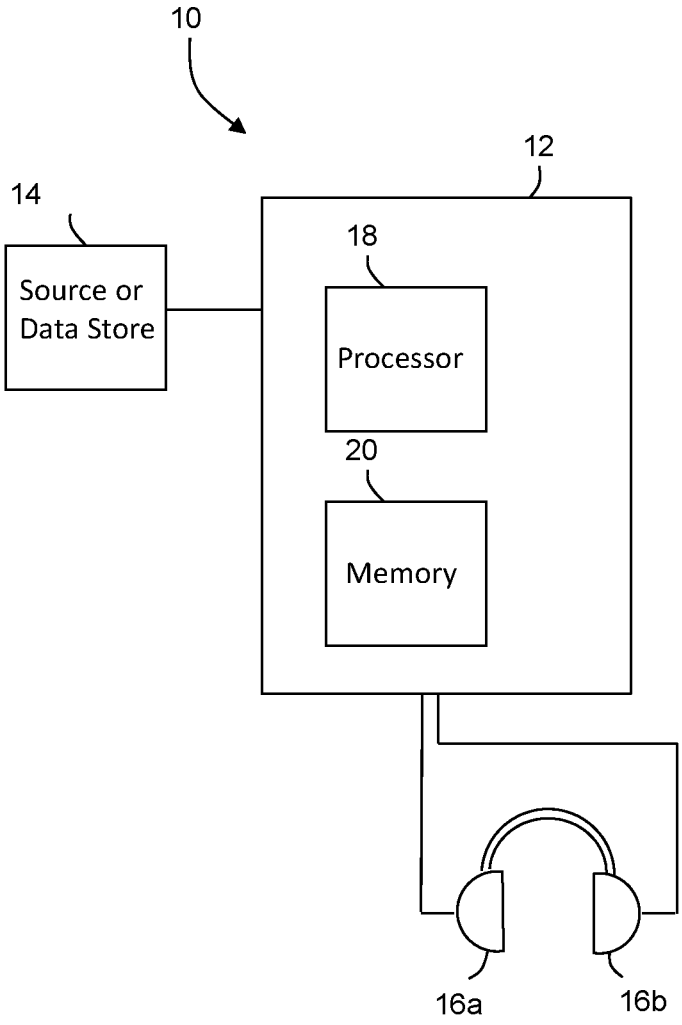
FIG. 1 is a schematic diagram of an audio system according to an embodiment.

An audio system 10 according to an embodiment is illustrated schematically in FIG. 1. The audio system comprises a computing apparatus 12 that is configured to receive monaural audio input from an input device, for example in the form of external source or data store 14, process the audio input to obtain a binaural output comprising a left output and a right output, and to deliver the binaural output to an output device, for example headphones 16*a*, 16*b*. The left output is delivered to left headphone 16*a* and the right output is delivered to right headphone 16*b*. In other embodiments, the binaural output may be delivered to at least two loudspeakers. For example, the left output may be delivered to a left loudspeaker and the right output may be delivered to a right loudspeaker. In some embodiments, the monaural audio input may be generated by or stored in computing apparatus 12 rather than being received from an external source or data store 14.

The computing apparatus 12 comprises a processor 18 for processing audio data and a memory 20 for storing data, for example for storing filter coefficients. The computing apparatus 12 also includes a hard drive and other components including RAM, ROM, a data bus, an operating system including various device drivers, and hardware devices including a graphics card. Such components are not shown in FIG. 1 for clarity.

In the embodiment of FIG. 1, a single computing apparatus 12 is configured to calculate and store filter coefficients of a structural model, calculate and store timbre filter coefficients, perform an initialisation by applying the timbre filter to the filter coefficients to obtain adjusted filter coefficients, and synthesise binaural audio output from monaural audio input using the adjusted filter coefficients. The processes performed by the computing apparatus 12 may include some offline processes and some real time processes. For example, calculation of timbre filter coefficients may be performed offline. Initialisation may be performed on start-up of an application. The synthesising of the binaural output may be performed in real time.

In other embodiments, audio system 10 may comprise a plurality of computing apparatuses. For example, a first computing apparatus may perform the calculation of timbre filter coefficients and a second, different computing apparatus may use the timbre filter coefficients to obtain adjusted filter coefficients and synthesise binaural audio output.

The system of FIG. 1 is configured to perform the method of an embodiment as described below with reference to FIGS. 2, 5 and 6.

A structural model is used to model the effect of the head and pinnae of a listener on sound received by the listener, so as to simulate binaural effects in audio channels supplied to a user's left and right ear. By providing different input to the left ear than to the right ear, the user is given the impression that an audio source originates from a particular position in space, or that each of a plurality of audio sources originates from a respective position in space. For example, the user may perceive that they are hearing sound from one source that is in front and to the right of them, and from another source that is directly behind them.

The structural model comprises a pinna filter, left and right interaural time delay (ITD) filters, and left and right head shadow filters. In the present embodiment, the pinna filter is applied to the audio input before the time delay filters and head shadow filters. In alternative embodiments, the pinna, ITD, and head shadow filters may be applied in any order.

The pinna filter is a FIR (finite impulse response) filter. Initial pinna FIR coefficients are obtained offline as described below with reference to stage 30 of FIG. 2 and stage 60 of FIG. 5. The initial pinna FIR coefficients are used to determine coefficients for a timbre filter as described below with reference to FIG. 2, the determining of the coefficients for a timbre filter being an offline process.

The initial pinna FIR coefficients and timbre filter are used as input to an initialisation process for a real-time binaural synthesis method. The initialisation process is described below with reference to FIG. 5. In the initialisation process, the initial pinna FIR coefficients and timbre filter are used to obtain adjusted pinna FIR coefficients at angular increments. The adjusted pinna FIR coefficients are stored in a look up table for use in a real-time binaural synthesis process.

The real-time binaural synthesis process is described below with reference to FIG. 6. Monaural audio input is processed using a pinna filter, left and right ITD filters, and left and right head shadow filters to produce binaural audio output. The binaural audio output is supplied to headphones 16*a*, 16*b*.

Figure 2:
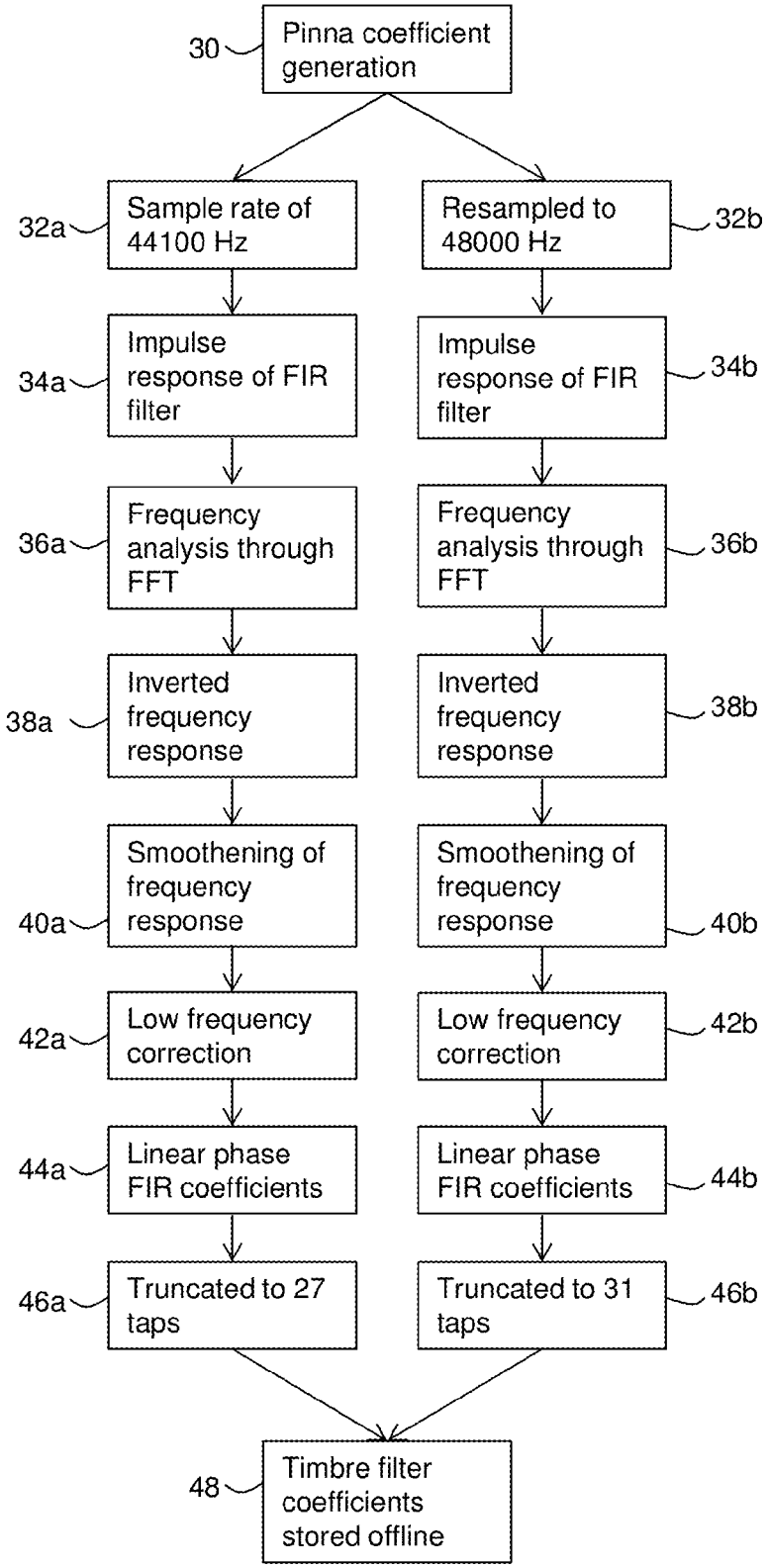
FIG. 2 is a flow chart illustrating in overview the process of an embodiment.

FIG. 2 is a flow chart showing in overview a method for determining timbre filter coefficients from initial pinna FIR coefficients. The timbre filter coefficients may be generated in such a way that a timbre filter using those coefficients may at least partially compensate for artefacts resulting from the initial pinna FIR coefficients.

At stage 30, initial pinna FIR coefficients are calculated offline by the processor 18. The initial pinna FIR coefficients are calculated from six pinna events in similar fashion to that described, for example, in Section IV-B of Brown, C. Phillip and Duda, Richard O., '*A structural model for binaural sound synthesis*', IEEE Transactions on Speech and Audio Processing, Vol. 6, No. 5, September 1998, which is incorporated by reference herein in its entirety. In the present embodiment, the initial pinna FIR coefficients are calculated for each ear and for each of a plurality of angular positions. In the present embodiment, the method of calculating initial pinna FIR coefficients comprises resampling values based on the system sample rate. In other embodiments, any suitable method of calculating initial pinna FIR coefficients may be used.

Angular positions are described using a $(r,\theta,\phi)$ coordinate system. An interaural axis connects the ears of a notional listener. The origin of the $(r,\theta,\phi)$ coordinate system is on the interaural axis, equidistant from the left ear and the right ear. r is the distance from the origin. The elevation coordinate, $\phi$, is zero at a position directly in front of the listener and increases with height. The azimuth coordinate, $\phi$, is zero at a position directly in front of the listener. The azimuth $\phi$ increases with angle to the listener's right and becomes more negative with angle to the listener's left. In the present embodiment, the initial pinna FIR coefficients are calculated at every 5° in azimuth and in elevation at stage 30. In other embodiments, initial pinna FIR coefficients are calculated only for one angular position, for example at ($\theta=0,\phi=0$) at stage 30 and initial pinna FIR coefficients for further angular positions are calculated at stage 60 of the process of FIG. 5.

A reflection coefficient and a time delay are associated with each of the six pinna events. $\rho_{pn}$ is the reflection coefficient for the nth pinna event, and $\tau_{pn}$ is the time delay for the nth pinna event. The reflection coefficients $\rho_{pn}$ are assigned constant values as shown in Table 1 below. Equation 1 is used to determine the time delays $\tau_{pn}$, which vary with azimuth and elevation.

$$\tau_{pn}(\theta, \phi) = A_n \cos\left(\frac{\theta}{2}\right)\sin[D_n(90^\circ - \phi)] + B_n, \quad \text{(Equation 1)}$$

$$-90^\circ \le \theta \le 90^\circ,\ -90^\circ \le \phi \le 90^\circ$$

where $A_n$ is an amplitude, $B_n$ is an offset, and $D_n$ is a scaling factor.

The coefficients for the left ear for an azimuth angle $\theta$ are the same as those for the right ear for an azimuth angle $-\theta$. Equation 1 is given in a general form. For the left ear, the coefficients are calculated with $\theta$ and for the right ear with $-\theta$.

In the present embodiment the values of $D_n$ are constant and do not change for different users. In other embodiments, different values of $D_n$ may be used for different users.

In the present embodiment, the coefficient values used are those given in Table 1 below. Table 1 gives coefficients for 5 of the 6 pinna events. The $6^{th}$ pinna event (n=1) is an unaltered version of the input. In other embodiments, different coefficient values may be used. A different number of pinna events or different pinna model may be used. Equation 1 above assumes a sampling rate of 44100 Hz. Other equations may be used for different sampling rates.

TABLE 1

| n | $\rho_{pn}$ | $A_n$ | $B_n$ | $D_n$ |
|---|---|---|---|---|
| 2 | 0.5 | 1 | 2 | 1 |
| 3 | −1 | 5 | 4 | 0.5 |
| 4 | 0.5 | 5 | 7 | 0.5 |
| 5 | −0.25 | 5 | 11 | 0.5 |
| 6 | 0.25 | 5 | 13 | 0.5 |

The calculation of the initial pinna FIR coefficients is performed at a sampling rate of 44100 Hz. The time delays calculated may not coincide exactly with sample times. The processor 18 uses linear interpolation to split the amplitudes $\rho_{pn}$ between adjacent sample points. The resulting pinna FIR filter is a 32 tap filter. In other embodiments, a pinna FIR filter having a different number of taps may be used.

The initial pinna FIR coefficient generation process of stage 30 produces a set of FIR coefficients to model the pinna. It has been found that pinna FIR filters derived using the method of stage 30 may change the timbre of an audio input when applied to that audio input.

The timbre of a sound may comprise a property or properties of the sound that is experienced by the user as imparting a particular tone or colour to the sound. In some circumstances, the timbre of a sound may indicate to a user which musical instrument or instruments produced that sound. For example, the timbre of a note produced by a violin may be different from the timbre of the same note produced by a trumpet. The timbre may comprise properties of the frequency spectrum of a sound, for example the harmonics within the sound. The timbre may comprise amplitude properties. The timbre may comprise a profile of the sound over time, for example properties of the attack or fading of a particular note.

It has been found in some known systems that a user listening to a monaural audio signal, and then to a binaural output signal that has been obtained from the monaural audio signal, is likely to experience the binaural audio output as having a different timbre from the monaural audio signal.

In many applications, it may be preferable for the timbre of a binaural sound to be perceived as similar to the timbre of the monaural sound from which the binaural sound was processed. For example, it may be more important that the user perceives the sound as having the expected timbre than that user perceives the sound as issuing from its precise position. In the method described below, a timbre compensation filter is used to make the binaural sound more similar to the original monaural sound, while retaining at least part of the effects of binaural processing.

The timbre of an audio input may relate to the frequency spectrum of that audio input. It has been found that if the initial pinna FIR coefficients of stage 30 are used for binaural synthesis without being modified, the resulting binaural sound output may exhibit a change in timbre that comprises a change in frequency spectrum. The change in timbre may be described as an unnatural boost to the high frequencies. Amplitudes at certain frequency ranges may be increased such that the timbre of sound to which a pinna filter using the initial pinna FIR coefficients has been applied is different to the timbre of the monaural audio input.

The human ear may be particularly sensitive to sounds in the range of 1 kHz to 6 kHz. Sounds in the range of 1 kHz to 6 kHz may be important in the human voice. It has been found that the initial pinna FIR coefficients of stage 80 may cause an increase in amplitude within the range of 1 kHz to 6 kHz. The increase in amplitude may be at a level that is perceptible by a user. For example, a user may not be aware of a 1 or 2 dB difference in amplitude, but may be aware of a greater difference in amplitude. If the increase in amplitude were not compensated for, a user may experience the binaural sound output of being of poor quality. Artefacts associated with the initial pinna FIR coefficients may cause the user to experience the binaural sound quality as being distorted.

In other embodiments, the use of unmodified binaural synthesis filter coefficients may cause artefacts in a binaural audio output that may comprise changes in timbre, changes in amplitude, changes in frequency, changes in delay, changes in quality (for example, changes in noise level or signal to noise) or changes in any other relevant parameter. The binaural synthesis coefficients may be any coefficients of any binaural synthesis model.

At stages 32 to 48 of the process of FIG. 2, initial pinna FIR coefficients for ($\theta=0,\phi=0$) are used to determine coefficients for a timbre compensation filter using an offline analysis. In other embodiments, respective timbre filter coefficients may be determined for each of a plurality of angular positions. Timbre filter coefficients may be generated using any appropriate method. Although in the present embodiment initial pinna FIR coefficients are used to determine coefficients for a timbre compensation filter, in other embodiments, any coefficients of a binaural synthesis model may be used to determine coefficients for a timbre compensation filter.

In the present embodiment, the timbre compensation filter is monaural, because at ($\theta=0,\phi=0$) the initial pinna FIR coefficients are the same for the left ear as for the right ear. In other embodiments, a timbre compensation filter may be generated for each ear. The timbre compensation filter for the left ear may be different from the timbre compensation filter for the right ear.

In the present embodiment, timbre filter coefficients are calculated at two sampling rates. The first sampling rate is 44100 Hz and the second sampling rate is 48000 Hz. In other embodiments, different sampling rates may be used. Timbre filter coefficients may be calculated for any number of sampling rates.

The flow chart of FIG. 2 shows corresponding stages (32*a* and 32*b*, 34*a* and 34*b*, 36*a* and 36*b* etc.) for each of the sampling rates. Stages for the first sampling rate (32*a*, 34*a*, 36*a* etc.) are described below in detail. The description of stages for the first sampling rate also applies to the stages for the second sampling rate (32*b*, 34*b*, 36*b* etc.) if the sampling rate referred to is changed accordingly.

At stage 32*a*, the initial pinna FIR coefficients obtained at stage 30 for angular position ($\theta=0,\phi=0$) are resampled if required. In the present embodiment, the initial pinna FIR coefficients are calculated at a sampling rate of 44100 Hz, which is the same as the first sampling rate. Therefore at stage 32*a* of the present embodiment, no resampling is performed.

At stage 34*a*, the processor 18 determines an impulse response, h(n), for the pinna filter using the initial pinna FIR coefficients for ($\theta=0,\phi=0$). n represents sample number (which may be described as a discretized measure of time). The processor determines the impulse response by inputting white noise into the pinna filter and plotting the output of the pinna filter.

The impulse response is found in order to correct for the boost to the high frequencies caused by the pinna model. White noise is used because it has constant amplitude with frequency. Any frequency effects seen in the impulse response may be due to the pinna FIR filter and not an effect of the input, since the white noise input does not vary with frequency. In other embodiments, any suitable method of obtaining the impulse response h(n) may be used.

At stage 36*a*, a frequency domain transfer function, $H(\omega)$, is determined from the impulse response, h(n). $\omega$ is angular frequency in radians per second, $\omega=2\pi f$, where f is frequency. The frequency domain transfer function, $H(\omega)$, is found by application of a Fourier transform to the impulse response, h(n). In the present embodiment, a fast Fourier transform (FFT) is used.

Figure 3:
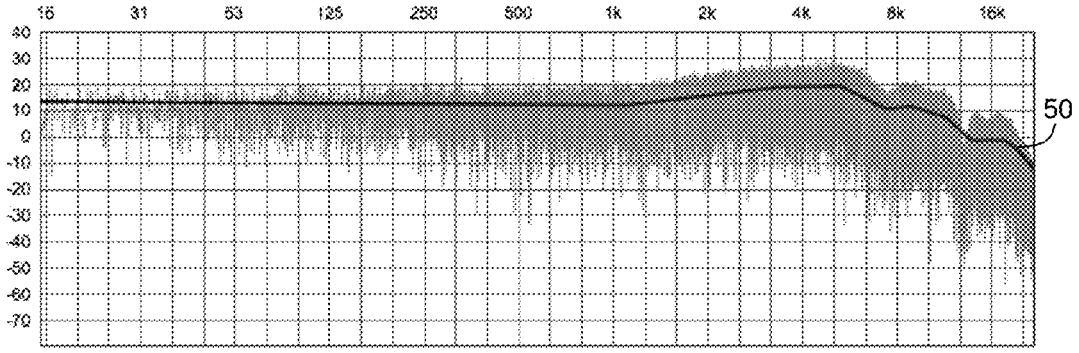
FIG. 3 is a plot of an exemplary frequency response of a pinna FIR filter.

FIG. 3 is a plot of the frequency domain transfer function $H(\omega)$. The horizontal axis of the FIG. 3 is frequency f in Hz. The vertical axis of FIG. 3 is gain in dBFS. The input signal level is 0 dBFS.

Line 50 of FIG. 3 is an averaged and smoothed version of the frequency domain transfer function $H(\omega)$. The averaged and smoothed response is calculated using a piecewise linear approximation algorithm. The linear piecewise approximation results in a continuous piecewise linear function which is defined on a set of points in the function's domain which are not necessarily regularly spaced. The points on which the function is defined may be irregularly spaced in order to minimise the number of line segments whilst maintaining an effective approximation. In other embodiments, any method of averaging and/or smoothing may be used.

If the pinna FIR filter did not change the frequency response of the audio input, line 50 would be expected to be flat with frequency. It may be seen that in FIG. 3, line 50 is fairly flat with frequency in the 0 Hz to 1000 Hz range. However, in FIG. 3, the transfer function $H(\omega)$ displays a clear boost in the high frequencies. Line 50 increases with frequency between 1000 Hz and 6000 Hz and then decreases at higher frequencies. In this example, gain increases from around 13 dBFS at low frequencies (for example, up to about 500 kHz) to around 20 dBFS at around 4 kHz.

Frequencies between 1000 Hz and 6000 Hz may be particularly relevant to the reproduction of the human voice, for example for speech intelligibility. FIG. 3 illustrates the presence of artefacts in the output of the pinna filter as described above. The artefacts affect the timbre of the output. The artefacts comprise an increase in gain in a sub-region of the frequency range, the sub-region comprising frequencies from 1000 Hz to 6000 Hz. In other embodiments, artefacts may be present in a different frequency range. Different artefacts may occur.

In some embodiments, artefacts may be present in the 80 Hz to 400 Hz range, which may be important for good low frequency reproduction, for example in music.

In the present embodiment, the frequency response of the pinna FIR filter is measured using white noise fed through the pinna FIR filter and plotted on a graph using FFT analysis. In alternative embodiments, alternative methods for determining the frequency response are used. In some embodiments, the frequency response is determined mathematically.

In the present embodiment, white noise is used to approximate real world situations. In other embodiments, a different sound input may be used in determining the frequency response.

At stage 38*a*, the processor 18 defines a transfer function for a corrective filter by determining the inverse of the frequency domain transfer function $H(\omega)$. The transfer function for the corrective filter is $W(\omega)$, where $W(\omega)=1/H(\omega)$. The inverse may be determined automatically, in response to user input, or by a combination of user input and automatic steps. The user of the process of FIG. 2 may be, for example, a sound designer. In some embodiments, a user of the process of FIG. 2 may determine parameters of the inverse function by ear.

At stage 40*a*, the processor 18 smooths the transfer function $H(\omega)$ using a piecewise linear approximation algorithm as described above. The smoothing may be performed automatically, in response to user input, or by a combination of user input and automatic steps. The transfer function is smoothed to only affect major peaks and troughs. If a highly accurate inverse function were used, a resulting timbre compensation filter may negate the effects of binaural processing. If a highly accurate inverse function were used, a resulting timbre compensation filter may return a signal similar to the original monaural audio input, as if the binaural processing had not been performed.

An inverse transfer function $W(\omega)$ is obtained by inverting the smoothed version of the transfer function $H(\omega)$.

At stage 42*a*, $W(\omega)$ is edited to ensure that frequencies below 400 Hz remain substantially unchanged. In the present embodiment, the processor 18 edits $W(\omega)$ in response to user input. In some embodiments, a user may edit $W(\omega)$ by ear. In other embodiments, the processor 18 may edit $W(\omega)$ automatically or by using a combination of user input and automatic steps.

Any corrections for low frequencies (below 400 Hz) that are present in $W(\omega)$ are reduced to maintain the low frequency response of the original pinna filter. $W(\omega)$ is altered such that a filter based on $W(\omega)$ will have substantially no effect on the binaural audio output in the frequency region below 400 Hz. Frequencies below 400 Hz may be important to a listener's perception of sound quality and/or sound localization.

In other embodiments, artefacts may occur in a low frequency range, for example in the 80 Hz to 400 Hz range. The timbre compensation filter may be required to correct artefacts below 400 Hz. In some cases, stage 42*a* may be omitted.

Figure 4:
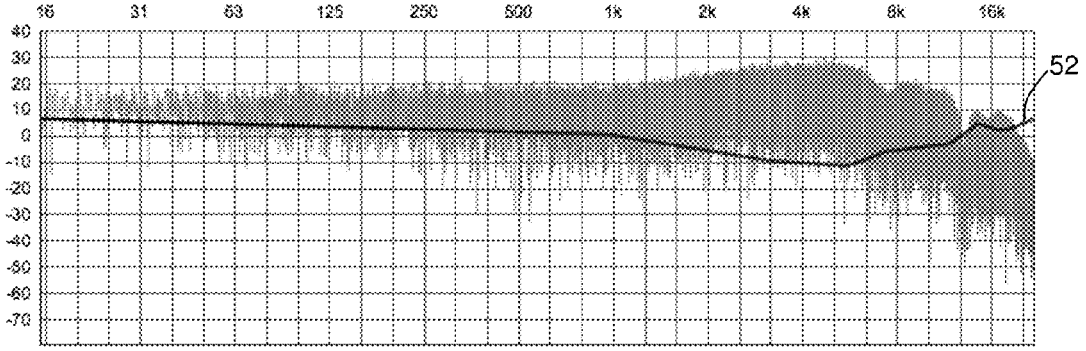
FIG. 4 is a plot of an inverted frequency response.

FIG. 4 is a plot of the transfer function H(ω) overlaid with an inverse function which is represented by line 52. The inverse function is obtained from the smoothed version of the transfer function.

In some embodiments, the transfer function H(ω) is smoothed and the inverse transfer function W(ω) is obtained from the smoothed version of H(ω). In some embodiments, the inverse transfer function W(ω) itself is smoothed. In some embodiments, the impulse function h(n) is smoothed. Smoothing may be performed before or after inverting. In some embodiments, other operations may be performed on the transfer function, inverse transfer function and/or impulse function in addition to or instead of smoothing.

At stage 44*a*, the processor 18 derives linear phase FIR filter coefficients for a timbre compensation filter from the inverse transfer function W(ω). The processor 18 obtains a new impulse response from W(ω). The new impulse response obtained from the FIR is linear phase. Linear phase helps compensate for group delays caused by the filter at a later point.

At stage 46*a*, the processor 18 truncates the linear phase FIR filter coefficients that were obtained at stage 44*a*. In the present embodiment, the linear phase filter coefficients are truncated using a Blackman window. The linear phase filter coefficients are truncated to 27 taps. The truncated linear phase coefficient are coefficients for a timbre compensation filter, and may be referred to as timbre filter coefficients.

The linear phase filter coefficients for the timbre compensation filter are truncated to maintain efficiency of the final system as is described below with reference to FIGS. 5 and 6. By using a low-order timbre compensation filter, initialisation and real-time synthesis may be performed efficiently. Initialisation and real-time synthesis may be performed using lower computational resources than would have been the case if a higher-order filter were used.

In this particular case, the pinna FIR filter has 32 taps. The number of taps of the timbre compensation filter (in this case, 27 taps) is less than the number of taps of the pinna FIR filter. When the timbre compensation filter is applied to the pinna FIR filter, the resulting pinna FIR filter does not have an increased number of taps. Using the pinna FIR filter to which the timbre compensation filter has been applied does not require greater computational resources than using the original pinna FIR filter.

Stages 32*b* to 46*b* performed for the second sampling rate (48000 Hz) are similar to stages 32*a* to 46*a* performed for the first sampling rate (44100 Hz). At stage 32*b*, the initial pinna coefficients are resampled to 48000 Hz. At stage 34*b*, white noise is fed through the resampled initial pinna filter to obtain an impulse response, $h_{48k}(n)$. At stage 36*b*, a FFT is used to obtain a frequency domain transfer function $H_{48k}(\omega)$. At stage 38*a*, the frequency domain transfer function $H_{48k}(\omega)$ is inverted, $W_{48k}(\omega)=1/H_{48k}(\omega)$. At stage 40*b*, the transfer function $H_{48k}(\omega)$ is smoothed so that it only affects major peaks and troughs and a new inverse transfer function $W_{48k}(\omega)$ is obtained. At stage 42*b*, $W_{48k}(\omega)$ is altered such that it has reduced effect on frequencies below 400 Hz. At stage 44*b*, linear phase FIR coefficients are obtained from $W_{48k}(\omega)$ by obtaining a new impulse function. At stage 46*b*, the linear phase FIR coefficients are truncated to 31 taps using a Blackman window. The output of stage 46*b* is a set of timbre filter coefficients for a 31-tap timbre compensation filter with a sampling rate of 48000 Hz.

The number of taps for the timbre compensation filter is less than the number of taps for the pinna FIR filter. Applying the timbre compensation filter to the pinna FIR filter does not increase the computational resources required to use the resulting pinna FIR filter.

At stage 48, the processor 18 stores the timbre filter coefficients from stages 46*a* and 46*b* in the memory 20. Coefficients are therefore stored for both the 44.1 kHz version and the 48 kHz version.

Although in the present embodiment, timbre filter coefficients are calculated for 44.1 kHz and 48 kHz sampling rates, in other embodiments timbre filter coefficients may be any sampling rates. Timbre filter coefficients may be calculated for any number of sampling rates.

Although a particular order of stages is shown in FIG. 2, in other embodiments the stages of FIG. 2 may be performed in any appropriate order. Stages may be omitted or additional stages may be added. Stages 32*a* to 46*a* may be performed simultaneously with stages 32*b* to 46*b*, or before or after stages 32*b* to 46*b*.

A timbre compensation filter using the timbre filter coefficients stored in stage 48 may be used to reduce artefacts caused by the pinna FIR filter. In this particular example, the artefacts comprise an increase in gain in a sub-region of the frequency range that is important for perception of the human voice (in this case, a sub-range of 1 kHz to 6 kHz). The timbre compensation filter may perform an equalization. The timbre compensation filter may improve the quality of output audio when compared with output audio generated without use of the timbre compensation filter.

In the present embodiment, the timbre compensation filter is low order (27 or 31 taps). The order of the timbre compensation filter is less than or equal to an order of the pinna FIR filter. Therefore, in some circumstances using pinna FIR coefficients to which the timbre compensation filter has been applied may not require increased computational resources when compared with using pinna FIR coefficients without the timbre compensation filter.

In the present embodiment, timbre filter coefficients are generated from coefficients for a pinna FIR filter. In other embodiments, timbre filter coefficients may be generated for any coefficients of a structural model. In further embodiments, timbre filter coefficients may be generated for coefficients of any binaural synthesis model. Any suitable method of generating a timbre compensation filter may be used.

Figure 5:
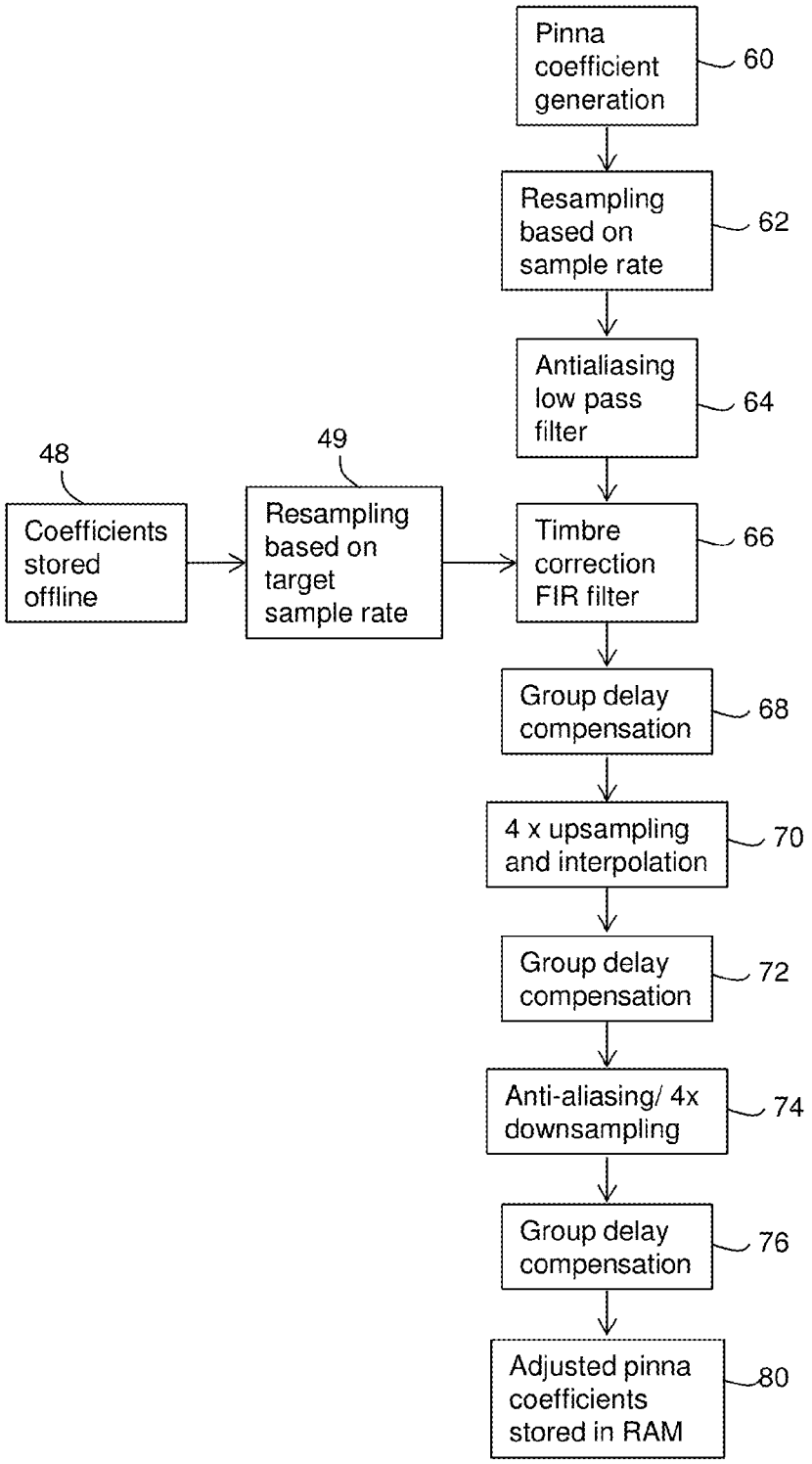
FIG. 5 is a flow chart illustrating in overview the process of an embodiment.

FIG. 5 is a flow chart showing in overview a method for determining adjusted pinna FIR coefficients from initial pinna FIR coefficients using the timbre filter coefficients that were generated using the process of FIG. 2. In the present embodiment, the process of FIG. 5 is performed as part of an initialisation process. The process of FIG. 5 may be performed as part of start-up of an application.

The process of FIG. 5 comprises applying a timbre compensation filter using coefficients obtained from the process of FIG. 2 to adjust initial pinna FIR coefficients such that artefacts caused by the initial pinna FIR coefficients may be reduced.

Figure 6:
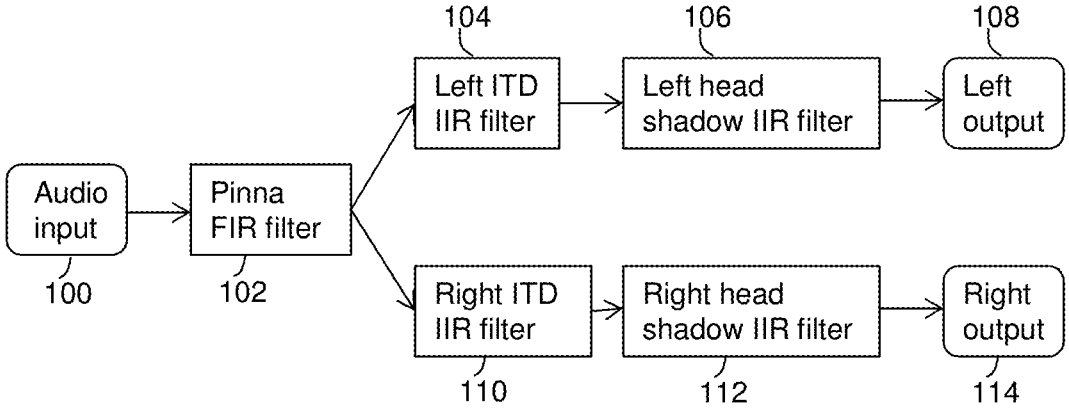
FIG. 6 is a flow chart illustrating in overview the process of an embodiment.

In the present embodiment, a single audio system 10 is used for the process of FIG. 2, the process of FIG. 5 and the process of FIG. 6. In other embodiments, the audio system 10 receives the timbre filter coefficients from a further system which may be, for example, a further audio system or a further computer. The further system performs the offline generation of the timbre filter coefficients from the initial pinna FIR coefficients using the process of FIG. 2. The further system then provides the timbre filter coefficients to the audio system 10. The timbre filter coefficients may be stored in memory 20.

The audio system 10 may comprise, for example, a computer or a mobile device such as a mobile phone or tablet. The process of FIG. 5 may be an initialization process that occurs, for example, on powering up the audio system 10 or on loading an application, for example on loading a game. In the initialisation process, the audio system 10 calculates adjusted pinna FIR coefficients for each of a plurality of angular positions and stores the adjusted pinna FIR coefficients in a look-up table for use in a subsequent real-time binaural synthesis process (for example, the binaural synthesis process of FIG. 6).

In the present embodiment, the sampling rate of the audio system 10 is 44100 Hz. In other embodiments, a different sampling rate may be used. For example, in some embodiments in which audio system 10 is a mobile device, a sampling rate lower than 44100 Hz may be used.

At stage 60 of FIG. 5, initial pinna FIR coefficients are generated as described above with reference to stage 30 of FIG. 2. In other embodiments, stored pinna FIR coefficients may be retrieved from memory 20 or from an alternative memory. Initial pinna FIR coefficients are generated across the full range of azimuth and elevation angles, at 5° intervals. Stages 62 to 76 of FIG. 5 are performed on the initial pinna FIR coefficients for each set of azimuth and elevation angles.

At stage 62 of FIG. 5, the initial pinna FIR coefficients are resampled based on the sample rate of the audio system 10. The initial pinna FIR coefficients were generated at a sample rate of 44100 Hz. In the present embodiment, the required sample rate is also 44100 Hz.

In other embodiments, initial pinna FIR coefficients are required for a sampling rate other than 44100 Hz. At stage 62, the processor 18 resamples the initial pinna FIR coefficients by multiplying and rounding the initial pinna FIR coefficients by a ratio, where the ratio is system sample rate divided by 44100.

At stage 64, the processor 18 applies an antialiasing low pass filter to the initial pinna FIR coefficients of stage 62. The antialiasing low pass filter removes high frequencies, thereby removing some artefacts. If resampling has been used, the initial pinna FIR coefficients to which the antialiasing low pass filter of stage 64 is applied are the resampled initial pinna FIR coefficients that were output from stage 62. In the present embodiment, the antialiasing low pass filter comprises a 41 tap low-pass Kaiser-Bessel FIR filter at 0.45 of the sample rate with 96 dB attenuation.

The Kaiser-Bessel filter may be obtained using a method taken from J. F. Kaiser, "*Nonrecursive digital filter design using $I_0$-sin h window function*", Proc. IEEE ISCAS, San Francisco 1974, which is incorporated by reference herein in its entirety.

Kaiser-Bessel window coefficients may be generated using Equation 2 below:

$$w[j] = \frac{I_0\left(\alpha\sqrt{1-\left(\frac{j-N_p}{N_p}\right)^2}\right)}{I_0(\alpha)} \quad \text{for } 0 \le j < M \qquad \text{(Equation 2)}$$

where j is sample number, w[j] is the window coefficient for sample number j, M is the number of points (taps) in the filter, $N_p=(M-1)/2$, $\alpha$ is the Kaiser-Bessel window shape factor and $I_0(\ )$ is the $0^{th}$ order Bessel function of the first kind.

The value of the window shape parameter $\alpha$ is calculated using the following equation:

$$\alpha = \begin{cases} 0.1102(Att-8.7) & Att > 50 \\ 0.5842(Att-21)^{0.4} + 0.07886(Att-21) & 21 \le Att \le 50 \\ 0 & Att < 21 \end{cases} \qquad \text{(Equation 3)}$$

In the present embodiment, Att=96. The Kaiser-Bessel FIR filter coefficients are calculated at 0.45 of sample rate with 96 dB attenuation.

Stages 48 and 49 of FIG. 5 are precursor stages to stage 70. Stage 48 is the end stage of the process of FIG. 2, in which timbre filter coefficients at multiple sampling rates are stored in memory. At stage 49, the stored timbre filter coefficients are resampled based on the sampling rate of the audio system 10. In the present embodiment, no resampling is required at stage 49 because the sampling rate of the audio system 10 is 44100 Hz and the stored timbre filter coefficients include a set of timbre filter coefficients at a sampling rate of 44100 Hz. In other embodiments, the timbre filter coefficients may be resampled from timbre filter coefficients at any stored sampling rate.

For example, in the present embodiment, timbre correction FIR filter coefficients are calculated at sample rates of 44100 Hz and 48000 Hz. The calculated timbre filter coefficients may be used as a base for resampling if the target sample rate is different. For example, 22050 Hz and 88200 Hz would be resampled versions of 44100 Hz (using 2× resampling). 24000 Hz and 96000 Hz would be resampled versions of 48000 Hz (using 2× resampling). Using timbre filter coefficients at multiple sampling rates (for example, 44100 Hz and 48000 Hz) may in some circumstances make it possible to resample data at a lower CPU cost than would be the case if the timbre filter coefficients had originally been calculated only at one sampling rate. For example, resampling from 44100 Hz to 96000 Hz is not a simple whole number multiplication and therefore is more CPU intensive than resampling from 48000 Hz to 96000 Hz, which does involve a simple whole number multiplication. The use of multiple sampling rates may improve cross-platform support.

The output of stage 49 is a set of timbre filter coefficients having an appropriate sampling rate, which may have been obtained by resampling if necessary. At stage 66, the processor 18 applies to the output of the antialiasing filter of stage 64 a timbre compensation filter using the timbre filter coefficients that were output from stage 49. The output of stage 64 is the set of initial pinna FIR coefficients to which an antialiasing low pass filter has been applied. The timbre compensation filter is applied by convolution in the time domain. The output of stage 66 is a set of pinna FIR coefficients that has been adjusted using the timbre compensation filter.

At stage 68, the processor 18 applies a group delay compensation to the output of the stage 66. The group delay compensation compensates for the delay caused by the timbre compensation filter. Since the timbre compensation filter has 27 taps, the timbre compensation filter causes a delay of 27/2−1 samples. If uncorrected, the delay due to the timbre compensation filter may affect latency, add delay, and/or affect the frequency response.

Since the timbre compensation filter is linear phase (the timbre filter coefficients having been converted to linear phase at stage 94), the group delay is a fixed value that is constant with frequency. The group delay compensation comprises removing the group delay.

At stage 70, the processor 18 applies 4× upsampling and interpolation to the output of stage 68. The coefficients are upsampled and interpolated using coefficients generated using a lowpass interpolation algorithm described in chapter 8 of Digital Signal Processing Committee of the IEEE Acoustics, Speech, and Signal Processing Society, eds, Programs for Digital Signal Processing, New York: IEEE Press, 1979.

In other embodiments, any method of performing upsampling and downsampling may be used.

At stage 72, the processor 18 applies group delay compensation to the output of the upsampling and interpolation of stage 70. Since the upsampling filter is linear phase, the group delay is a fixed value that is constant with frequency. The group delay compensation comprises removing the group delay.

At stage 74, the processor 18 applies an antialiasing and 4× downsampling to the output of stage 110. In the present embodiment, antialiasing is performed using a 51 tap Kaiser-Bessel FIR filter at 0.113 of sample rate with 96 dB attenuation. The equations for the Kaiser-Bessel filter are the same as Equations 2 and 3 above.

At stage 76, the processor 18 applies group delay compensation to the output of the antialiasing and downsampling of stage 74. Since the downsampling filter is linear phase, the group delay is a fixed value that is constant with frequency. The group delay compensation comprises removing the group delay.

The output of stage 76 is a set of adjusted pinna FIR coefficients for each of the plurality of angular positions for which initial pinna FIR coefficients were calculated at stage 60. At stage 78, the adjusted pinna FIR coefficients are stored in RAM. In the present embodiment, the adjusted pinna FIR coefficients are stored in memory 20. The adjusted pinna FIR coefficients are stored as a look-up table. Values of the adjusted pinna coefficients are stored for every 5° interval in azimuth and in elevation.

FIG. 6 is a flow chart showing in overview a method of processing monaural audio input to obtain binaural sound by using a structural model for binaural synthesis. The process of FIG. 6 uses the lookup table of stored adjusted pinna FIR coefficients that was obtained using the process of FIG. 5.

At stage 100, monaural audio input is received by the computing apparatus 12 from a data store 14. The monaural audio input is representative of sound from a plurality of sound sources. In other embodiments, the monaural audio input may be representative of sound from a single sound source.

Each of the sound sources is assigned a respective position relative to a notional listener in distance, azimuth and elevation. Sound source positions are described using the $(r,\theta,\phi)$ coordinate system described above, centred on the notional listener. The assigned position for each source is used in the binaural synthesis process. An aim of the binaural synthesis process may be to synthesise binaural sound such that, when a user listens to the binaural sound through headphones 16*a*, 16*b*, each sound source appears to the user to originate from its assigned position.

The position of a sound source may be a virtual or simulated position. For example, in a computer game, the coordinate system used to position sound sources may be centred on a camera position from which a scene is viewed. A simulated object in the game may have an associated position in a coordinate system of the game which may be used in, for example rendering an image of the simulated object, or for determining collisions between the simulated object and other simulated objects. A audio input may be associated with a sound source that is given the same position as the position of the simulated object in the coordinate system of the game. After binaural synthesis, the audio input may appear to the user to emanate from the simulated object.

In some embodiments, the positions of sound sources move with time. For example, where sound sources are associated with simulated objects in a game, the position of each sound source relative to the notional listener may change with time as objects in the game are moved relative to the coordinate system of the game.

In the present embodiment, the monaural audio input is a sound recording of a plurality of sound sources, for example a plurality of instruments or voices. In other embodiments, the monaural audio input may comprise at least one computer-generated sound source and/or at least one recorded sound source. In some embodiments, sound sources may be generated by the processor 18 or by a further processor. In the present embodiment, the monaural audio input has a sampling rate of 44100 Hz. In other embodiments, the monaural audio input may have a different sampling rate.

In the present embodiment, stages 102 to 114 of the flow chart of FIG. 6 occur in real time. Binaural audio output is generated at the same rate that it is output (in this embodiment, a sampling rate of 44100 kHz). In other embodiments, stages 52 to 64 may occur offline. Binaural audio output may be generated at a speed that is not real time, and may be played back in real time.

At stage 102, the processor 18 applies to the monaural audio input an adjusted pinna FIR filter, which is a filter using adjusted pinna FIR coefficients that were stored in a lookup table at stage 80 of FIG. 6. In the present embodiment, the coefficients of the adjusted pinna FIR filter are dependent on $\theta$ and $\phi$. The coefficients for the left ear for an azimuth angle $\theta$ are the same as those for the right ear for an azimuth angle $-\theta$. For each sound source in the monaural audio input, the processor 18 obtains adjusted pinna FIR coefficients corresponding to the angular position of the sound source and applies to the audio input for that sound source the adjusted pinna FIR coefficients for that angular position. Therefore, different adjusted pinna FIR filters are used for sound sources having different angular positions. The adjusted pinna FIR filters are also different for the left ear than for the right ear. The adjusted pinna FIR filter outputs a binaural output comprising a left output and a right output.

In the present embodiment, the adjusted pinna coefficients that are used for a given angular position are the adjusted pinna coefficients for the nearest angular position in the lookup table. No interpolation is performed. In other embodiments, the values for the adjusted pinna coefficients for a given angular position may be interpolated from the adjusted coefficients in the lookup table.

Figure 7:
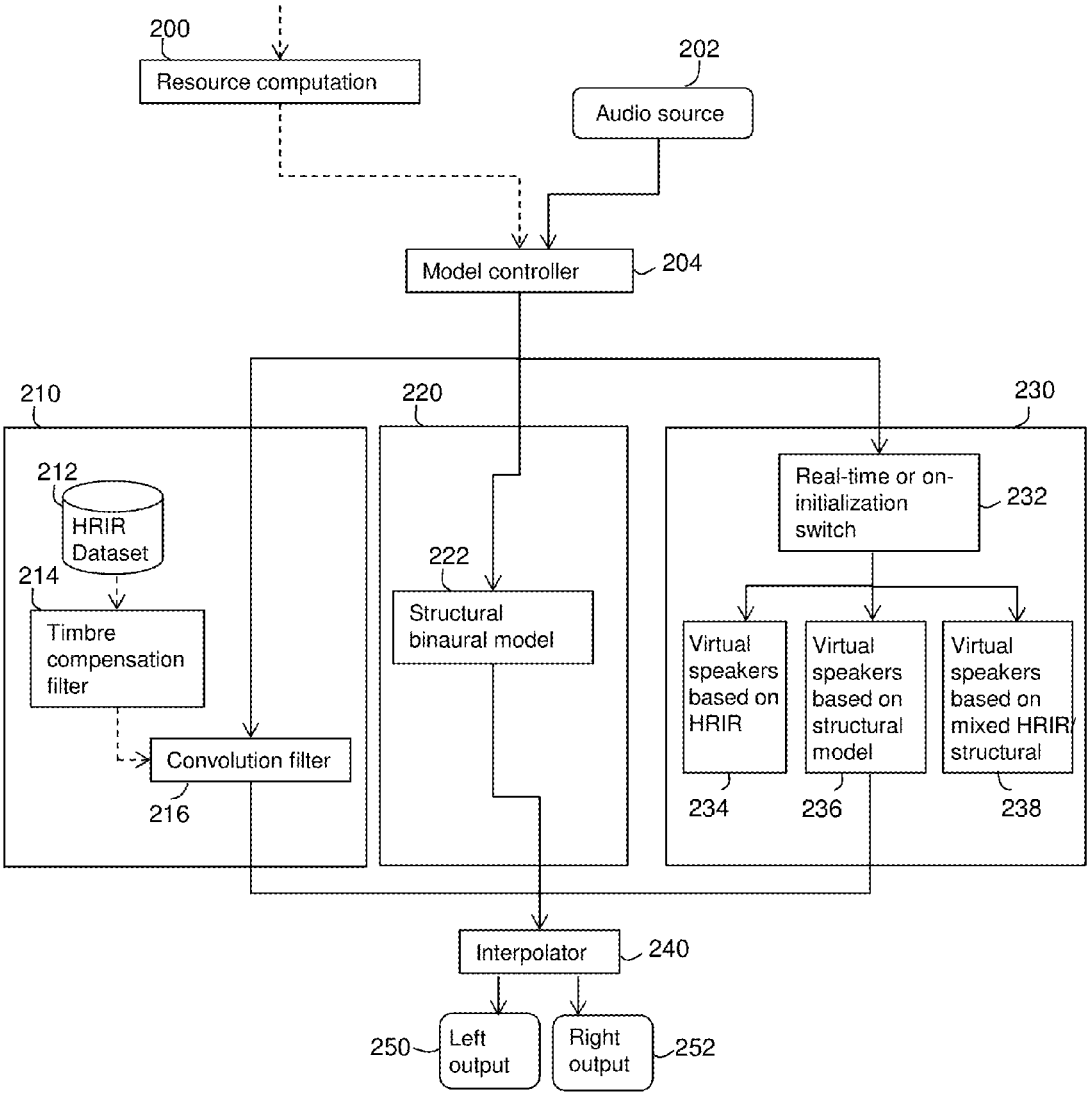
FIG. 7 is a flow chart illustrating in overview the process of an embodiment.

In the present embodiment, the coefficients of the adjusted pinna FIR filter are determined before the process of FIG. 7 (in this embodiment, using the process of FIG. 6) and not as part of a real time process. In other embodiments, the adjusted pinna FIR coefficients may be determined in real time.

At stage 104, the processor 18 applies a left ITD IIR (interaural time difference infinite impulse response) filter to the left output of the pinna FIR filter. In the present embodiment, as in the paper by Brown and Duda, the interaural time difference $T(\theta,\phi)$ represents a difference between the time that sound is received at an ear, and the time that sound would be received at the origin of the coordinate system. In other embodiment, any definition of ITD may be used.

In the present embodiment, interaural time differences are calculated based on an average head size. A distance between ears and head size are used that represent average values for a population. The distance between ears and head size that are used for the calculation of ITD remain the same for all users. In other embodiments, different distance between ears, head size and/or other parameters (for example, values for pinna time delays) may be used for different users. For example, a user may select parameters such as head size either by inputting values or by selecting from a range of options (such as small, medium, large). The processor 18 may select parameters to use for the ITD calculation depending on user input or a user profile.

An interaural time difference $T(\theta,\phi)$ is calculated for each sound source in dependence on the azimuth and elevation of the sound source.

$$T(\theta,\phi)=\begin{cases}-\frac{a}{c}*\cos(\theta)*\cos(\phi), & 0\le|\theta|<\frac{\pi}{2}\\ \frac{a}{c}*\left(|\theta|-\frac{\pi}{2}\right)*\cos(\phi), & \frac{\pi}{2}\le|\theta|\le\pi\end{cases} \quad \text{(Equation 4)}$$

where a is an average head size (which is taken to be the head size of the notional listener), c is the speed of sound, $\theta$ is azimuth angle in radians and $\phi$ is elevation angle in radians. In the present embodiment, interaural time difference is independent of frequency. In other embodiments, the interaural time difference may be dependent on frequency. Any suitable equation for interaural time difference may be used in stage 104.

At stage 104, for each sound source, the time delay of $T(\theta,\phi)$ is applied to the output of the pinna FIR filter.

At stage 106, the processor 18 applies a left head shadow IIR filter to the output of stage 104. For each sound source, the head shadow filter is a function of frequency and of azimuth angle. In the present embodiment, the head shadow filter is independent of elevation angle. In other embodiments, any suitable head shadow filter may be used. The left head shadow filter is calculated in dependence on the same average head size, a, as is used for the calculation of the interaural time delay. The head shadow filter is calculated using Equation 5.

$$H(\omega,\theta)=\left(1+\frac{j(\alpha*\omega)}{2\omega_0}\right)\Big/\left(1+\frac{j\omega}{2\omega_0}\right),\ 0\le\alpha(\theta)\le 2 \quad \text{(Equation 5)}$$

$\alpha(\theta)$ is a coefficient which depends on azimuth angle, and which is calculated using Equation 6.

$$\alpha(\theta)=1.05+0.95*\cos\left(\theta*\frac{\pi}{180}\right) \quad \text{(Equation 6)}$$

$\theta$ is azimuth angle in degrees, $\omega$ is radian frequency and $\omega_0=c/a$.

The equations used in the present embodiment for calculating the ITD filter and head shadow filter may in some circumstances provide increased spatial accuracy.

At stage 108, the processor 18 outputs a left binaural output to the left headphone. The left binaural output is a combination of outputs for the plurality of sound sources. For each sound source, a pinna FIR filter, ITD filter and head shadow filter have been applied in dependence on the azimuth and elevation angles of the source.

Stages 110 to 114 are similar to stages 104 to 108, but are applied to the right output of the pinna FIR filter rather than to the left output of the pinna FIR filter. At stage 110, the processor 18 applies a right ITD IIR filter to the right output of the pinna FIR filter. At stage 112, the processor 18 applies a right head shadow IIR filter to the output of the right ITD IIR filter. For each filter, the coefficients for the left ear for an azimuth angle $\theta$ are the same as those for the right ear for an azimuth angle $-\theta$.

At stage 114, the processor 18 outputs a right binaural output to the right headphone. The right binaural output is a combination of outputs for the plurality of sound sources. For each sound source, a pinna FIR filter, ITD filter and head shadow filter have been applied in dependence on the azimuth and elevation angles of the source.

Binaural synthesis coefficients may be updated with time, for example to take account of relative motion between the listener and the source. The method of FIG. 6 may be performed repeatedly in real time.

The right and left binaural outputs of FIG. 6 were calculated using adjusted pinna FIR coefficients which were determined using a timbre compensation filter. The timbre compensation filter is used to correct timbre and sound quality artefacts created by the structural model. It may also be used to correct the low frequency response of the system.

In the present embodiment, the correction of the high frequencies by the timbre compensation frequency may make it sound like the low frequencies have also been corrected, due to the psychoacoustic effect. In other embodiment, more drastic low frequency correction may be applied. The low frequency correction may be such that no binaural processing is applied on low frequencies. A lack of binaural processing at low frequencies may be used by sound designers in some specific circumstances.

The improved timbral quality resulting from the timbre compensation filter may also improve the spatialisation quality of the system, as the binaural output may be a more faithful representation of the monaural input.

Existing binaural systems are known to use filters for changing the response of the system to match specific headphone models (for example). However, filters in such known systems may be high order FIRs that require convolution in the frequency domain. For example, headphone compensation filters applied to an audio output may use 1024 taps. The use of such high order filters may increase CPU usage and latency of the system. In some existing methods, a filter for changing the response of the system is applied to a binaural output. For example, a low pass filter may be used on the binaural audio output. A lowpass filter may smooth the frequency response, but may lose high frequencies. By contrast, in the method of the present embodiment, a timbre compensation filter is applied to coefficients of the structural model to remove artefacts. In the method of the present embodiment, high frequencies may not be lost.

In the present embodiment, the timbre compensation filter is independent of physical properties of at least part of the audio system. For example, the timbre compensation filter may be independent of properties of headphones 16*a*, 16*b*. The timbre compensation filter may be used to compensate for artefacts in the binaural synthesis method, and not to compensate for other effects such as, for example, headphone characteristics. The timbre compensation filter may be independent of properties of the scene and/or of virtual objects or sound source in the scene. The timbre compensation filter may be independent of physical characteristics of a user.

In the present embodiment, the timbre compensation filter is of comparatively low order (27 to 31 taps). The low order of the timbre compensation filter may ensure that the number of taps for the pinna FIR filter is maintained at the original 32 taps after the timbre compensation filter is applied to coefficients of the pinna FIR coefficients. Therefore it may be the case that no additional computational resources are required in order to implement the method of the present embodiment, compared to a method that does not use a timbre compensation filter to compensate for artefacts.

In some circumstances, the CPU requirement for the present method may be substantially the same as for a structural model method that did not use a timbre compensation filter as described. CPU requirements may be very important for audio processing, because in some systems audio must be processed in an all-purpose CPU, as compared to graphics processing which may be performed on a dedicated GPU (graphics processing unit).

The timbre compensation method described above may be used for any appropriate audio system. For example, the method may be used in an audio system proving high-quality reproduction of audio input. The method may be used in virtual reality or augmented reality systems. The method may be used in a computer game. In some circumstances, the method may be used on a device such as a mobile phone. Such a device may have limited computational resources. Use of the timbre compensation method may allow binaural output with acceptable audio quality to be obtained within the limits of the device's computational resources. Binaural synthesis may be provided on devices that do not have sufficient computational resources to support more computationally-intensive methods of binaural synthesis, for example HRIR methods.

In some applications, good audio quality may be more important to a user than precise positioning of sounds. It may be important to the user that timbre is corrected, even if that is at the expense of positioning. It may be preferable to hear sound from an audio source that sounds correct but has only approximate positioning in space, than to hear a precisely-positioned sound that is of degraded quality.

Maintaining the pinna FIR filter at 32 taps may maintain the efficiency of the structural model while increasing its quality. The quality of the structural model may be increased by the reduction of artefacts. The small number of coefficients of the pinna FIR filter may lead to the structural model requiring less computational power than methods that use a greater number of filter coefficients (for example, HRIR methods).

In the present embodiment, a timbre compensation filter is applied to coefficients of a pinna FIR filter to compensate for artefacts that would otherwise be caused by the pinna FIR filter. In other embodiments, the coefficients to which the timbre compensation filter is applied may be any coefficients of a structural model. The coefficients from which the timbre compensation filter is generated may be any coefficients of a structural model. In further embodiments, the coefficients to which the timbre compensation filter are applied may be coefficients of any binaural synthesis model. The coefficients from which the timbre compensation filter is generated may be any coefficients of a binaural synthesis model.

One binaural synthesis method is HRIR convolution binaural synthesis. An HRIR database model may be obtained by using two microphones at ear canal positions of a head model to capture a broadband impulse at different positions. A number of HRIR database models are available. In one embodiment of an HRIR convolution binaural synthesis method, a timbre compensation filter is applied to HRIR coefficients from an HRIR database. The HRIR coefficients may be, for example, between 128 and 512 taps. A convolution filter is used to perform a convolution of a monaural audio input with the HRIR coefficients that have been adjusted by the timbre compensation filter.

Another binaural synthesis method may comprise performing binaural synthesis using virtual speakers. The virtual speakers may use either VBAP (Vector Base Amplitude Panning) or Ambisonics. In one embodiment, timbre compensation filter may be applied to coefficients of a virtual speaker method.

Virtual speakers (for binaural audio over headphones) are binaural sound sources that are represented as speakers, but that are still played back over headphones. For example, instead of using 100 discrete sound sources to play back 100 sounds, the whole field may be represented with 10 binaural sources spread out around the listener, just as 10 speakers may surround a listener in real life.

FIG. 7 is a flow chart illustrating in overview a method in which a model controller may choose between and/or interpolate between the outputs of different methods of binaural synthesis, including the structural model method of binaural synthesis described above with reference to FIG. 6. The method of FIG. 7 may be described as a dynamic resource based binaural synthesis model.

In the method of FIG. 7, three types of binaural synthesis are provided: HRIR convolution binaural synthesis 210, a structural model with timbre compensation filter 220 (which may be a method as described above with reference to FIG. 6) and a virtual speaker system 230. The virtual speaker system 230 may use either VBAP or Ambisonics.

At stage 200 of FIG. 7, the processor 18 performs a resource computation to determine how much computational resource is available for binaural synthesis. Inputs to the resource computation may include real time parameters. Inputs to the resource computation may include, for example, CPU frequency, a developer-specified resource limit and/or quality requirements.

Results of the resource computation are passed to the model controller. In the present embodiment, the model controller is implemented in the processor 18. In other embodiments, the model controller may be a separate component, for example a separate processor.

At stage 202 a real time monaural audio input comprising audio input from a plurality of audio sources, and information about the each audio source, is passed to the model controller.

The information about each audio source may comprise real-time parameters. The information about each audio source may include, for example, a priority level associated with the audio source, a distance associated with the audio source, and/or quality requirements associated with the audio source. More important sources may be assigned a higher priority than less important sources.

For each sound source that is input to the method, a model controller decides which of the types of binaural synthesis to use.

At stage 204, for each audio source, the model controller determines which of the binaural synthesis methods will be used for performing binaural synthesis of the audio source. The model controller may decide to interpolate between the outputs of different types of binaural synthesis. The model controller 204 may decide between binaural synthesis methods depending on the results of the resource computation 200 and/or depending on the information associated with the audio source in input 202. In the present embodiment, the model controller 204 decides between synthesis methods using an automatic process. In some embodiments, the process for deciding between synthesis methods is user-definable.

In the embodiment of FIG. 7, the model controller 204 chooses between HRIR convolution binaural synthesis 210, structural model 220 and virtual speaker system 230. For each audio source, the model controller 204 determines which one or more of the binaural synthesis methods 210, 220, 230 should be used to perform binaural synthesis of audio input for that audio source.

HRIR convolution binaural synthesis 210 may in some circumstances be of high quality but computationally intensive. The structural model 220 may in some circumstances be of lower quality than the HRIR convolution binaural synthesis 210, but considerably less computationally intensive. The model controller 204 may choose to synthesise high priority audio sources using HRIR convolution binaural synthesis 210 and lower priority audio sources using the structural model 220. In some circumstances, high priority audio sources may always be synthesised using the highest-quality synthesis method available. In other embodiments, high-priority audio sources may be synthesised using the highest-quality synthesis method when they are close to the listener, but may be synthesised with a lower-quality synthesis method when they are further from the listener. In some embodiments, low-priority audio sources may always be synthesised using a lower-quality and/or less computationally intensive synthesis method. The model controller 204 may perform a trade-off between different criteria, for example a trade-off between memory requirements and quality.

In some cases, the model determines that binaural synthesis will be performed on an audio source using HRIR convolution binaural synthesis. The audio input is passed to a convolution filter 216. For each audio source, the HRIR dataset 212 provides HRIR filter coefficients for the audio source position to a timbre compensation filter 214. If no HRIR filter coefficients are available for the position of the audio source, HRIR filter coefficients may be interpolated from nearby positions for which HRIR filter coefficients are available. The HRIR filter coefficients are adjusted by the timbre compensation filter 214. The timbre compensation filter 214 may be different from a timbre compensation filter used by the structural binaural model. The timbre compensation filter 214 may be generated using a method similar to the method of FIG. 2.

The adjusted HRIR filter coefficients are provided to the convolution filter 216. In the convolution filter 216, the audio input is convolved with the adjusted HRIR filter coefficients. The output of the convolution filter 216 is passed to the interpolator 240. In the present embodiment, the HRIR dataset 212 is stored in memory 20 and the timbre compensation filter 214 and convolution filter 216 are each implemented in processor 18.

In some cases, the model controller 204 passes the audio input data to the structural model with timbre compensation filter 220 which comprises a structural model process 222. For each audio source, the structural binaural model process 222 implements the structural model of FIG. 6 using the timbre compensation filter of FIG. 2. The output of the structural binaural model process 222 is passed to the interpolator 240.

In some cases, the model controller 204 passes the audio source data to a virtual speaker system 230. In the present embodiment, the virtual speaker system 230 is implemented in processor 18. In other embodiments, the virtual speaker system 230 may be implemented in a separate processor or other component.

A switch 232 determines how the virtual speaker system 230 will process the audio input. In a first setting 234, the virtual speaker system 230 uses virtual speakers based on the HRIR database with a timbre compensation filter. The timbre compensation filter may be different to the timbre compensation filter 214 used by the HRIR method and the timbre compensation filter used by the structural binaural model. The timbre compensation filter may be obtained using a method similar to the method of FIG. 2.

In a second setting 236, the virtual speaker system 230 uses virtual speakers based on a structural model with a timbre compensation filter. The timbre compensation filter may be different from the timbre compensation filter of the first setting. In a third setting 238, the virtual speaker system 230 uses virtual speakers based on a mix of a structural model and the HRIR database with at least one timbre compensation filter. The output of the virtual speaker system 230 is passed to the interpolator 240.

In the present embodiment, the interpolator 240 is part of processor 18. In other embodiments, the interpolator 240 may be a separate component, for example a further processor.

The interpolator 240 combines outputs from the HRIR model 210, structural model 220 and/or virtual speaker system 230 as appropriate. The interpolator 240 outputs a left output 250 and right output 252 to headphones 16*a*, 16*b*.

In some circumstances, the model controller 204 determines that a single one of the binaural synthesis methods 210, 220, 230 should be used to perform binaural synthesis for a given audio source. The selected one of the binaural synthesis methods 210, 220, 230 is used to perform binaural synthesis for that source, and the interpolator 240 outputs a binaural output for that source that has been generated using the selected one of the binaural synthesis methods 210, 220, 230.

The binaural synthesis method 210, 220, 230 selected for one source may be different from the binaural synthesis method 210, 220, 230 selected for another, different source. For example, a binaural synthesis method with a higher-quality output and having a higher computational load may be used for a source that appears closer to the user, and a different binaural synthesis method having a lower-quality output and a lower computational load may be used for a source that appears to be further from the user. A higher-quality binaural synthesis method may be used for higher-priority audio sources, and a lower-quality binaural synthesis method for lower-priority audio sources. A higher-quality binaural synthesis method may be used for louder audio sources, and a lower-quality binaural synthesis method for quieter audio sources.

In some circumstances, the model controller 204 determines that more than one of the binaural synthesis methods 210, 220, 230 should be used to perform binaural synthesis for a given source. The outputs of the more than one binaural synthesis methods for that source are combined by the interpolator 240 to provide a combined audio output for that source. The combined output is output as left output 250 and right output 252.

The outputs from different binaural synthesis methods may be combined by interpolation. In this context, interpolation may refer to mixing outputs of different methods to combine a given proportion of one output with a given proportion of another output. The output of a first binaural synthesis method may be faded down over time in the combination, while the output of a second binaural synthesis method may be faded up over time in the combination. Weights may be assigned to the output from each binaural synthesis method, and the outputs from the binaural synthesis methods may be combined in accordance with their assigned weights.

For example, a sound source may be changing in position over time such that it moves further away from the position of the listener. At a first time, when the sound source has a position close to the listener, audio input from that sound source may be synthesised using a HRIR convolution synthesis method 210. As the sound source moves away, the audio input may be synthesised using both HRIR synthesis 210 and structural model synthesis 220. The contribution of the HRIR synthesis 210 may be decreased as the sound source moves away from the listener. The contribution of the structural model synthesis 220 may be increased as the sound source moves away from the listener. Once the sound source reaches a given distance, the audio input from that sound source may be synthesised using only the structural model 220.

By synthesising audio output from a source using more than one synthesis method and combining (for example, interpolating) the outputs from the different synthesis methods, a smooth transition may be provided between the outputs of the different synthesis methods, so that a user may not notice that the synthesis method for a given sound source has changed. From the user's perspective, there may appear be a seamless switch between different binaural synthesis methods.

By applying a timbre compensation filter in each of the synthesis methods, the timbre of the sound may be consistent regardless of which synthesis method or methods are used. The timbre compensation filter used in one method may be different from the timbre compensation filter used in another method. For example, a different timbre compensation filter may be used in the HRIR synthesis method than in the structural model synthesis method. The timbre compensation filters may be designed to match the timbre between output synthesised using one method and output synthesised using another method.

For each synthesis method, a respective timbre compensation filter may be obtained using an offline analysis method, for example an offline analysis method similar to that described above with reference to FIG. 2 in the case of the structural model.

In methods described above, the same output is produced for every user. For example, when calculating structural model coefficients, an average head size and ear spacing are used. In other embodiments, the structural model may be individualised to different users. For example, a head size and/or ear spacing of the individual user may be used. In some embodiments, a user may select parameters of the structural model.

While certain processes have been described as being performed offline, in other embodiments those processes may be performed in real time. While certain processed have been described as being performed in real time, in other embodiments those processes may be performed offline.

Whilst components of the embodiments described herein (for example, filters) have been implemented in software, it will be understood that any such components can be implemented in hardware, for example in the form of ASICs or FPGAs, or in a combination of hardware and software. Similarly, some or all of the hardware components of embodiments described herein may be implemented in software or in a suitable combination of software and hardware.

It will be understood that the present invention has been described above purely by way of example, and modifications of detail can be made within the scope of the invention. Each feature disclosed in the description, and (where appropriate) the claims and drawings may be provided independently or in any appropriate combination.

The invention claimed is:

1. A method comprising:

obtaining one or more sets of initial filter coefficients, each set of initial filter coefficients corresponding to an angular position defined by an azimuth angle and an elevation angle; and adjusting each set of initial filter coefficients with a timbre compensation filter to reduce artefacts associated with a binaural audio output resulting from a binaural synthesis filter;

wherein the adjusted sets of filter coefficients are provided to the binaural synthesis filter to synthesise the binaural audio output based on a monaural input, wherein synthesising the binaural audio output comprises convolving at least one of the adjusted sets of filter coefficients with the monaural audio input.

2. The method of claim 1, wherein the artefacts comprise a reduction in quality of the binaural audio output.

3. The method of claim 1, wherein the artefacts comprise at least one of: a change in amplitude of the binaural audio output, a change in delay of the binaural audio output, and a change in frequency of the binaural audio output.

4. The method of claim 1, wherein the binaural audio output occupies a frequency range, and wherein the artefacts are present in a sub-region of the frequency range.

5. The method of claim 4, wherein the sub-region comprises audible frequencies of human voice.

6. The method of claim 1, wherein adjusting each set of initial filter coefficients with the timbre compensation filter comprises applying the timbre compensation filter to each set of filter coefficients to obtain the adjusted filter coefficients.

7. The method of claim 1, further comprising:

receiving the monaural audio input, the monaural audio input corresponding to and audio source having an associated position; and synthesising binaural audio output from the monaural audio input using the binaural synthesis filter, wherein the synthesising depends on the position associated with the audio source.

8. The method of claim 1, wherein each set of filter coefficients is adjusted with the timbre compensation filter such that the binaural audio output synthesised using the adjusted coefficients has a different timbre from binaural audio output synthesised using the initial filter coefficients to reduce an effect of the artefacts.

9. The method of claim 8, wherein the synthesising is performed in real time, the position the audio source changes with time, and the synthesising of the binaural audio output is updated with the changing position of the audio source.

10. The method of claim 1, further comprising generating the timbre compensation filter from one of the sets of initial filter coefficients.

11. The method of claim 10, wherein generating the timbre compensation filter from one of the sets of initial filter coefficients comprises:

applying a filter defined by one of the sets of initial filter coefficients to a test audio input to obtain an impulse response;

obtaining a transfer function by applying a Fourier transfer to the impulse response; and generating the timbre compensation filter from the transfer function.

12. The method of claim 11, wherein generating the timbre compensation filter from the transfer function comprises inverting the transfer function.

13. The method of claim 12, wherein generating the timbre compensation filter further comprises reducing an effect of the timbre compensation filter at low frequencies, and wherein the low frequencies comprise frequencies below 400 Hz.

14. The method of claim 10, wherein generating the timbre compensation filter comprises generating the timbre compensation filter for each of a plurality of sampling rates.

15. The method of claim 10, wherein generating the timbre compensation filter comprises truncating the timbre compensation filter to an order no higher than an order of the binaural synthesis filter.

16. The method of claim 10, wherein the test audio input comprises an audio input having a known frequency profile, and wherein the generating of the timbre compensation filter depends on a difference between a frequency profile of the binaural audio output and the known frequency profile of the test audio input.

17. The method of claim 1, wherein the binaural synthesis filter comprises a pinna model filter.

18. The method of claim 17, wherein synthesising the binaural audio output further comprises:

applying an interaural time delay; and applying a head shadow filter.

19. The method of claim 18, further comprising determining values for the interaural time delay using the equation:

$$T(\theta, \phi) = \begin{cases} -\frac{a}{c} * \cos(\theta) * \cos(\phi), & 0 \le |\theta| < \frac{\pi}{2} \\ \frac{a}{c} * \left(|\theta| - \frac{\pi}{2}\right) * \cos(\phi), & \frac{\pi}{2} \le |\theta| \le \pi \end{cases}$$

wherein T (θ,ϕ) is the interaural time delay, a is an average head size, c is the speed of sound, θ is an azimuth angle in radians and ϕ is an elevation angle in radians.

20. The method of claim 18, further comprising determining values for the head shadow filter using the equation:

$$H(\omega, \theta) = \frac{\left(1 + \frac{j(\alpha * \omega)}{(2\omega_0)}\right)}{\left(1 + \frac{j\omega}{2\omega_0}\right)}, \; 0 \le \alpha(\theta) \le 2$$

wherein H(ω,θ) is a head shadow filter value, θ is an azimuth angle in degrees, ω is a radian frequency, a is an average head size, c is the speed of sound, $\omega_0$=c/a, and $$\alpha(\theta) = 1.05 + 0.95 * \cos\left(\theta * \frac{\pi}{180}\right).$$

21. The method of claim 1, wherein adjusting each set of initial filter coefficients with the timbre compensation filter comprises, for each angular position, applying the timbre compensation filter to the set of filter coefficients for the angular position—to obtain adjusted filter coefficients for the angular position.

22. A method comprising:

obtaining a set of initial filter coefficients for a binaural synthesis filter, the set of initial filter coefficients corresponding to an angular position defined by an azimuth angle and an elevation angle; and generating a timbre compensation filter from the set of initial filter coefficients, wherein the timbre compensation filter is used to adjust the set of initial filter coefficients to reduce artefacts associated with a binaural audio output resulting from the binaural synthesis filter, and wherein the adjusted set of filter coefficients is provided to the binaural synthesis filter to synthesise the binaural audio output based on a monaural audio input, wherein synthesising of the binaural audio output comprises convolving the adjusted set of filter coefficients with the monaural audio input.

23. A method comprising:

receiving a monaural audio signal corresponding to an audio source, the audio source having an associated position; and synthesising a binaural audio output from the monaural audio signal using a binaural synthesis filter, wherein the synthesising depends on the position associated with the audio source, wherein the binaural synthesis filter uses adjusted filter coefficients that were adjusted using a timbre compensation filter to reduce artefacts associated with the synthesised binaural audio output.

24. An apparatus comprising:

a means for obtaining one or more sets of initial filter coefficients, each set of initial filter coefficients corresponding to an angular position defined by an azimuth angle and an elevation angle; and a means for adjusting each set of initial filter coefficients with a timbre compensation filter to reduce artefacts associated with a binaural audio output resulting from a binaural synthesis filter;

wherein the adjusted sets of filter coefficients are provided to the binaural synthesis filter to synthesise the binaural audio output based on a monaural audio input, wherein synthesising the binaural audio output comprises convolving at least one of the adjusted sets of filter coefficients with the monaural audio input.

25. A non-transitory computer readable storage medium storing instructions, the instructions when executed by a processor cause the processor to:

obtain one or more sets of initial filter coefficients, each set of initial filter coefficients corresponding to an angular position defined by an azimuth angle and an elevation angle; and adjust each set of initial filter coefficients with a timbre compensation filter to reduce artefacts associated with a binaural audio output resulting from a binaural synthesis filter;

wherein the adjusted sets of filter coefficients are provided to the binaural synthesis filter to synthesise the binaural audio output based on a monaural audio input, wherein synthesising the binaural audio output comprises convolving at least one of the adjusted sets of filter coefficients with the monaural audio input.

* * * * *